US005705329A

United States Patent [19]

Nakajima et al.

[11] Patent Number: 5,705,329

[45] Date of Patent: Jan. 6, 1998

[54] SILVER HALIDE PHOTOGRAPHIC LIGHT-SENSITIVE MATERIAL

[75] Inventors: Akihisa Nakajima; Koichi Nagayasu, both of Hino, Japan

[73] Assignee: Konica Corporation, Japan

[21] Appl. No.: 838,466

[22] Filed: Apr. 7, 1997

Related U.S. Application Data

[63] Continuation of Ser. No. 539,274, Oct. 4, 1995, abandoned.

[30] Foreign Application Priority Data

Oct. 6, 1994 [JP] Japan ..... 6-243055
Oct. 26, 1994 [JP] Japan ..... 6-262561

[51] Int. Cl.[6] ..... G03C 1/76

[52] U.S. Cl. ..... 430/536; 430/523; 430/527; 430/531; 430/537

[58] Field of Search ..... 430/536, 523, 430/527, 537, 531

[56] References Cited

U.S. PATENT DOCUMENTS

H1515 1/1996 Hattori et al. ..... 430/522
4,542,093 9/1985 Suzuki et al. ..... 430/523
5,188,930 2/1993 Funaki et al. ..... 430/531
5,582,964 12/1996 Hashimoto et al. ..... 430/536

FOREIGN PATENT DOCUMENTS 0456163 11/1991 European Pat. Off. .
2077745 12/1981 United Kingdom .

OTHER PUBLICATIONS

Patent Abstracts of Japan, vol. 11, No. 208, p. 593, Jul. 7, 1987.

JP-A-62-030 246, Konishiroku Feb. 9, 1987 Abstract (1 page).

*Primary Examiner*—Geraldine Letscher
*Attorney, Agent, or Firm*—Jordan B. Bierman; Bierman, Muserlian and Lucas LLP

[57] ABSTRACT

Disclosed is a silver halide photographic light-sensitive material comprising a support provided thereon, a layer selected from the group consisting of a first layer and a second layer, and a silver halide emulsion layer in this order, wherein said support comprises a syndiotactic styrene polymer or a copolymer thereof, and a first layer comprises a polymer composition composed of a polyester component with a styrene polymer component, and a second layer comprises a diene type polymer.

15 Claims, No Drawings

SILVER HALIDE PHOTOGRAPHIC LIGHT-SENSITIVE MATERIAL

This application is a continuation of application Ser. No. 08/539,274, filed Oct. 04, 1995, now abandoned.

FIELD OF THE INVENTION

The present invention relates to a silver halide light-sensitive photographic material obtained by the use of a support, having excellent sizing stability, and having a subbing layer thereon, by which excellent coating and adhesion properties to the photographic constituent layers provided thereon, is obtainable.

BACKGROUND OF THE INVENTION

Various properties are required for a photographic support, including, for example, not only optical transparency, but also accessibility to treatment for improving adhesion to a hydrophilic photographic emulsion layer to be provided thereon, sizing stability and anti-curling property. For these reasons, use of a variety of synthetic resin sheets and films have heretofore been proposed and attempted.

Generally, for a photographic support used by being wound on a small core, cellulose triacetate(TAC) is often employed and as for the photographic support used in the form of a roll wound around a larger core or sheets, polyethyleneterephthalate(PET) is popularly used.

Recently, with the increased demand of enhancing information density per unit area, stricter size stability of the light-sensitive photographic material has also been demanded. For the photographic light-sensitive material used as a intermediate recording medium for a variety of purposes and, an image is obtained by using several kinds of recording media in sequence, and an adverse consequence is that once a wrong measurement is used, it becomes impossible to obtain a clear photographic image.

These sort of dimensional discrepancies are caused partly because hydrophilic binder consisting mainly of gelatin used in the constituent layers of the light-sensitive photographic material is easily affected by the environmental humidity, and partly because PET and TAC comprise hydrophilic portions in their molecules as structure and, therefore, they are also effected by the environmental humidity.

As a countermeasure, for example, a technique of providing a water-proof layer consisting of polyvinylidene chloride on the support is known, however, there are problems that, (a) when the support is stored for a long time, dechlorination progresses gradually, yellow stain occurs on the film, that (b) when the cut-off edge portions are collected and re-used in a film coating step, the above-mentioned yellow stain takes place due to dechlorination, and that (c) re-use of the support resin becomes impossible because of vinylidene chloride is present as impurities, and once upon incineration, chlorine gas is generated, which has an adverse effect on the environment.

Generally, polystyrene does not have dimensional stability due to heat as it is not crystalline, however, so-called syndiotactic polystyrene disclosed in Japanese Patent Publication O.P.I. Publication No. 131843/1991, is a highly crystalline and has an advantage in that it shows an excellent dimensional stability.

On the contrary, however, because of its excellent crystalline property, the syndiotactic polystyrene can not be easily treated with surface treatment to obtain good adhesion property. Further, there is a problem that the syndiotactic polystyrene has a high hydrophobicity on its surface, so that coating property is bad and uneven coating tends to occur when a subbing layer is provided on the surface thereof.

The present invention has been accomplished in view of the above mentioned background state of the art, and, accordingly the object of the present invention is to improve coating performance and adhesion property of the photographic constituent layers on a photographic support made of syndiotactic polystyrene, which has excellent dimensional stability.

SUMMARY OF THE INVENTION

The above-mentioned object of the present invention can be achieved by the following constitutions.

Item 1: A silver halide photographic light-sensitive material comprising a support providing thereon, a hydrophobic polymer layer, and a silver halide light-sensitive layer, wherein said support comprises a styrene polymer having a racemo chain as a main chain or a composition containing said styrene polymer.

Item 2: The silver halide photographic light-sensitive material of item 1, wherein said hydrophobic layer comprises a styrene-diene copolymer.

Item 3: A method for preparing the silver halide photographic light-sensitive material of item 1, wherein said method comprising the steps of:

(a) subjecting said support to a corona discharge treatment, a grow discharge treatment, a flame treatment or a ultraviolet radiation treatment, and (b) coating said hydrophobic polymer layer and a silver halide photographic light-sensitive layer.

Item 4: The method of item 3, wherein a de-electrification treatment is carried out before or after subjecting said support to a corona discharge treatment, a grow discharge treatment, a flame treatment or a ultraviolet radiation treatment.

Item 5: A method for preparing the silver halide photographic light-sensitive material of item 1, wherein said method comprising casting steps of:

(a) coating said hydrophobic polymer on said support, (b) extending the polymer coated support in at least one direction, (c) applying a heat treatment to the extending support, and (d) coating said silver halide photographic light-sensitive layer on the heat-treatment support.

Item 6: The method for preparing the silver halide photographic light-sensitive material of item 5, wherein said hydrophobic polymer layer comprises a styrene-diene copolymer.

Item 7: A method for a silver halide photographic light-sensitive material comprising a support and provided thereon, a hydrophobic layer, a hydrophilic layer, and a silver halide photographic light-sensitive layer, comprising the steps of:

(a) coating said polymer layer and said hydrophilic colloid layer on said support, wherein said support comprises a styrene polymer having a racemo chain as a main chain or a composition containing said styrene polymer, (b) applying a heat-treatment to the coated support at a temperature range of not less than 40° C. and not more than of a glass transition temperature of said support, and (c) coating a silver halide emulsion layer on the heat treatment material.

Item 8: The method of item 7, wherein said hydrophobic polymer layer comprises a styrene-diene copolymer.

Item 9: The method of item 5, wherein said method comprises a step of applying a heat-treatment to the coated support at a temperature range of not less than 40° C. and not more than of a glass transition temperature of said support after coating step of said hydrophobic layer and before coating step of said silver halide photographic light-sensitive layer.

Item 10: The method of item 9, wherein said hydrophobic polymer layer comprises a styrene-diene copolymer.

Item 11: A silver halide photographic light-sensitive material comprising a support containing a syndiotactic styrene based polymer having a racemo chain, and thereon, a hydrophilic photographic layer through a layer, wherein said layer comprises a polymeric composition containing a water-dispersible or a water-soluble polyester and a styrene based polymer, and a compound represented by formula I.

Item 12: The silver halide photographic light-sensitive material of item 11, wherein the polymeric composition is selected from the group consisting of a first dispersion polymerization of a styrene in the presence of a water-dispersive or a water-soluble polyester and a second dispersion polymerization of a styrene and a monomer being capable of reacting the styrene in the presence of a water-dispersive or a water-soluble polyester.

Item 13; The silver halide photographic light-sensitive material of item 11, wherein said polymeric composition comprises a polymer prepared by polymerizing styrene and a monomer being capable of copolymerizing with styrene in the presence of a water dispersible or water-soluble polyester as a main chain.

Item 14: The silver halide photographic light-sensitive material of item 11, 12 or 13, wherein said layer comprises a water-soluble electron-conductive compound and a polyglycerin compound.

Item 15: The silver halide photographic light-sensitive material of item 11, 12 or 13, wherein said silver halide photographic light-sensitive material is prepared by a method comprising the steps of:

(a) coating said layer comprising said polymeric composition on said support, (b) extending the coating material to at least one direction, (c) applying a heat treatment to the extended coating material so as to orientate to crystal of said syndiotactic polystyrene of said support, and (d) coating a hydrophilic photographic layer on the heat treatment material.

That is to say, the present inventors have reached the present invention by finding a fact that a composition which is most suitable for a subbing layer, in the case where a syndiotactic polystyrene based support having excellent dimensional stability is used as a the support.

Below, the present invention is further explained in detail.

In the present invention, the term "a film having a syndiotactic styrene polymer as its main component" shows a styrene polymer or a composition containing it, of which tacticity (stereoregularity structure) consists mainly of a syndiotactic structure, and when the syndiotactic styrene polymer is composed of a homopolymer of styrene, it can be obtained according to the method disclosed in Japanese Patent O.P.I. Publication No. 62-117708(1987) and according to the method disclosed in Japanese patent O.P.I. Publication Nos. 1-46912(1990) and 1-178505(1990), etc. in the case of other polymers.

Its tacticity can be analyzed quantitatively by using nuclear magnetic resonance method (13C-NMR) using an isotope of carbon. The quantitative analysis by using the nuclear magnetic resonance is carried out by the similar method disclosed in Macromol. Chem, 176, 3051 (1975).

The tacticity measured by the 13C-NMR can be calculated as the existence ratio of the structural unit having a plural of the continuous number. For example, a tacticity as diad in the case of two continuous number, a tacticity as triad in the case of three continuous number and a tacticity as pentad in the case of five continuous number, are respectively calculated.

In the present invention, the syndiotactic styrene polymer or the copolymer thereof has a racemo-diad of not less than 75 mole %, preferably of not less than 85 mole % and more preferably of not less than 95 mole %.

As the racemo diad of the present invention, each of monomer units forming the racemo diad may be same or different.

Furthermore, the above-mentioned racemo diad is preferably represented by Formula 3.

Formula 3

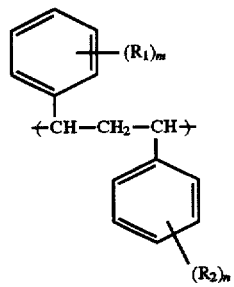

wherein $R_1$ and $R_2$ each represents a hydrogen, a chloro atom, a bromine atom, a fluorine atom, an iodine atom, an alkyl group, an aryl group, an alkoxy group, an carboxyl group, a sulfo group, a hydroxy group, an amino group, a sulfamoyl group, a carbamoyl group, a halogenated alkyl group, a cyano group, an alkoxycarbonyl group.

As for specific monomers being capable of forming the syndiotactic styrene polymer composition, for example, a styrene, an alkyl styrene such as a methyl styrene; a halogenated alkyl styrene such as chloromethylstyrene and chlorostyrene, an alkoxystyrene, an ester of vinylbenzoate and a mixture of thereof. Particularly, a copolymer of an alkylstyrene and styrene is one of preferable combinations in order to obtain a film having thickness of not less than 50 μm.

When preparing the polystyrene based resin having the syndiotactic structure of the present invention, a transition metal compound and a compound having aluminoxane as a main component or a transition metal compound and a compound being capable of forming an ionic complex by the reaction with the transition metal compound disclosed in Japanese Patent O.P.I. Publication No. 320448/1993, can be employed as a polymerization catalyst.

In order to prepare the styrene polymer used for the film of the present invention, first the above-mentioned styrene monomer is polymerized, after sufficient refining, in the presence of any one of the above-mentioned polymerization catalysts. The polymerization is carried out usually at the temperature of −50° and 200° C. and, more preferably, 30° to 100° C. for the period of one second to 10 hours and, more preferably, for the period of one minute to six hours. For the manner of polymerization, any one of slurry polymerization method, solution polymerization method, bulk polymerization method and gas-phase polymerization can be employed. Further it may be either a continuous or a non-continuous polymerization. Here, in the solution polymerization, as the solvent, for example, one or more kinds of solvents selected from, for example, aromatic hydrocarbon solvent such as benzene, toluene, xylene and ethylbenzene; an aliphatic hydrocarbon solvent such as cyclopentane, hexane, heptane, octane can be employed either singly or two or more kinds in combination.

In this case, a volume ratio of the monomer to the solvent may optionally be selected. Further, regulation of molecular weight and the composition may be controlled according to the ordinary method which is commonly employed in the art.

Adjustment of molecular weight of the polymer can be made by, for example, hydrogen, temperature and monomer concentration.

It may be possible to copolymerize other monomers being capable of copolymerization together with the above-mentioned styrene monomer within the extent which does not jeopardize the advantage of the present invention.

Polymers used for film manufacturing of the SPS (syndiotactic styrene polymer) has a weight average molecular weight of not less than 10,000 and, more preferably, of not less than 30,000. Polymers having weight average molecular weight of less than 10,000 do not usually become films having excellent strength and anti-heat resistant properties.

Although there is no specific limit as to the upper limit of the weight average molecular weight, however, in the case it exceeds 1,500,000, there is a possibility that tearing off of the film due to stretching tension takes place.

Although there is no specific limitation as to the molecular weight of the SPS as far as a film can be manufactured, it is preferable that the weight average molecular weight is 10,000 to 3,000,000 and, more preferably, 30,000 to 1,500,000. Further as to the molecular weight distribution given in terms of a number average molecular weight/a weight average molecular weight is preferably 1.5 to 8. This molecular weight distribution can be adjusted by mixing polymers having different molecular weight.

Further, the syndiotactic styrene polymer of the present invention is dried by drying syndiotactic styrene polymer pellets at a temperature of 120° to 180° C. for 1 to 24 hours under reduced pressure or the atomospheric pressure and inactive gas surroundings such as air or nitrogen gas. There is no specific limitation as to the moisture content, however, in the view of preventing deterioration of the mechanical strength by hydrolysis, the moisture content is not more than 0.05%, preferably not more than 0.01% and, more preferably, not more than 0.005%. However, of course, so far as the advantages of the present invention are attainable, the method is not limited to the above-mentioned.

The SPS film of the present invention preferably consists solely of an SPS film prepared from styrene, however, it is possible to control crystallization speed and make the film stronger by mixing a styrene polymer having an isotactic structure (IPS).

Although the mixing weight ratio of the SPS and the IPS (a styrene based polmer having an isotactic structure in which a main chain is a meso-continuous chain) may be varied depending on the degree of stereoregularity of the respective polymers, however, it is 30:70 and 99:1 in terms of a weight ratio and, more preferably 50:50 to 98:2 in terms of a weight ratio.

In the support of the present invention, in order to have a function, a variety of additives including, for example, inorganic fine particles, an anti-oxidation agent, a ultraviolet-ray absorbent, an anti-static agent, a coloring agent, a pigment, a dye, etc can be incorporated within the extent which jeopardize the object of the present invention.

For the extruding method at the time of manufacturing the film, any conventional method may be applied. For example, a extrusion method by the use of a T-die is preferable. An unstretched film is manufactured by melting a syndiotactic polystyrene pellet at a temperature of 280° to 350° C., extruding, cooling and solidified on a casting roll while applying electrostatic potential.

Next this unstretched is biaxially stretched for the polymer crystal to set to be oriented biaxially. For the method of stretching, any appropriate method from a variety of known methods, for example, including one after another biaxial stretching method in which a longitudinal stretching and a lateral stretching are carried out in this order, another one after another biaxial stretching method in which a lateral stretching and a longitudinal stretching are carried out in this order, a lateral-longitudinal-lateral stretching method, a longitudinal-lateral-longitudinal stretching method, a longitudinal-longitudinal-lateral stretching method or simultaneous biaxial stretching method may optionally be selected depending on the required properties such as mechanical strength and dimensional stability, etc.

Generally in the continuous manufacturing, longitudinal stretching means stretching in the above-mentioned longitudinal direction, and lateral stretching means stretching in the width direction. That is to say, in the continuous manufacturing, one after another biaxial stretching, in which a film is first stretched in the above-mentioned longitudinal direction and, subsequently in the lateral direction, is preferable. In this case, stretching magnification is 2.5 to 6 times with respect to the longitudinal direction, and, the longitudinal stretching temperature depends upon Tg (the glass transition temperature) of the polymer, so that the longitudinal stretching temperature is usually set to be Tg plus 10° C. to Tg plus 50° C.

In the case of a syndiotactic polystyrene based film, it may be preferably carried out at the temperature of 110° to 150° C. The lateral stretching temperature is preferably carried out at the temperature of 115° to 160° C. being a slightly higher than longitudinal stretching temperature.

Next, this stretched film is subjected to heat treatment. In this case, the treatment temperature may be varied depending upon utility. For the shrinkage packing use, usually not more than 150° C., For photographic, printing or medical use, in which excellent dimensional stability is required, a temperature of 150° to 270° C. may optionally be selected.

Although there is no specific limitation as to the time for the heat treatment, one second to two minutes is usually applied. As a matter of course, if necessary, a heat relaxation treatment either in the longitudinal direction or in the lateral direction can be employed. Hereafter, the film may be cooled rapidly and wound up. However, after cooling down the temperature gradually at the temperature between Tg and the heat treatment temperature while spending 0.1 minute to 1500 hours, the film is wound around a core having a larger diameter, and further, cooling down is carried out at the cooling rate of −0.01° to −20° C./min at the temperature range of 40° C. and Tg. It is preferable from a viewpoint that curling habit may not easily be conferred on the film. Of course, the heat treatment at a temperature of 40° C. and Tg is preferably carried out for a time of 0.1 minute to 1500 hours in a thermostatic chamber during a period in which a support film is wound up, a silver halide emulsion is coated on the support film, and the silver halide emulsion coated film is cut.

In addition to the film-manufacturing process as mentioned above, for the purposes of conferring enhanced lubrication, adhesion or anti-static properties on the film, a SPS-laminated SPS film, in which a SPS support is laminated on at least one surface of the SPS support, may also be manufactured. SPS laminating on the SPS support may be performed by, for example, after laminating with layer flow state under which the resin is melted, extruding from a die, or by laminating by extrusion with melting SPS resin on a cooled and solidified SPS unstretched support or on a SPS mono-axially stretched support and, thereafter, stretching thus SPS-laminated SPS film support in both longitudinal and lateral directions or in the direction perpendicular to the direction in the mono-axial stretching and thermally fixing this. Extruding conditions of the SPS resin, stretching temperature, magnification rate of stretching, thermal-fixing temperature, etc. may be varied depending on the combination of the SPS to be laminated, however, a fine tuning of the film manufacturing condition is carried out, so that it is possible to select the optimum condition, and therefore, a drastic revision of the film manufacturing condition is not necessary.

Needless to say, lamination may consist of two or more layers, and they are combinations of either the similar kinds of polymers, including combinations of copolymers, or different kinds of polymers.

The above film-manufacturing method can optionally be changed depending upon its use and object and, accordingly, the manner of manufacturing is by no means limited to those mentioned above.

Thickness of the thus obtained syndiotactic polystyrene based stretched film can vary depending upon its use, including, for example, 0.3 μm for extremely thin condensers, 6 μm or 12 μm for ordinary condensers, 100 μm for light-sensitive materials for medical and printing uses and 250 μm-thick for electric insulating materials (Slotriner), however, the above-mentioned film manufacturing method is effectively applied to a film having a thickness of 0.3 to 500 μm.

In the present invention, the thickness of the support is 50 to 500 μm, and more preferably, 70 to 250 μm and the haze of the support is preferable not more than 5%.

Next, respective ingredients used in the subbing layer of the present invention are explained.

The polyester used in the present invention is a substantially linear polymer obtained by through condensation polymerization of a polybasic acid, a polybasic acid having a sulfo group or ester-forming derivative thereof and a polyol or an ester-forming derivative thereof. As for the polybasic acid ingredient of the polymer, for example, terephthalic acid, isophthalic acid, phthalic acid, phthalic acid anhydride, 2,6-naphtharenedicarboxylic acid, 1,4-cyclohexanedicarboxylic acid, adipic acid, sebacic acid, trimellitic acid, pyromellitic acid and dimeric acid can be mentioned. Together with those mentioned above, a small proportion of an unsaturated polybasic acid such as maleic acid, fumaric acid and itaconic acid or a hydroxylcarbonic acid such as p-hydroxylbenzoic acid and p-(β-hydroxyethoxy)benzoic acid. The polyester is preferably a water-dispersible polyester, and in the present invention, a term "a water-dispersible polyester" is defined as a polyester having polyester particle size of several tens nm to several hundreds nm in water.

As for the polyol ingredients, for example, ethylene glycol, diethylene glycol, 1,4-butane diol, neopentyl glycol, dipropyrene glycol, 1,6-hexane diol, 1,4-cyclohexane dimethanol, xylirene glycol, trimethylol propane, poly (ethyleneoxide)glycol, and poly(tetramethyleneoxide)glycol can be mentioned.

As for the dicarboxylic acid or ester derivative thereof having a sulfonate, used in the present invention, one having an alkali sulfonate group is particularly preferable, including, for example, an alkali metal salt or an ester derivative thereof of 4-sulfo-isophthalic acid, 5-sulfo-isophthalic acid, sulfoterephthalic acid, 4-sulfo-phthalic acid, 4-sulfonaphthalene-2,7-dicarboxylic acid and 5-(4-sulfophenoxy) isophthalic acid can be mentioned, and a sodium isophthalate or an esteric derivative thereof is particularly preferable.

These are preferably contained in an amount of 5 to 15 mol %, particulayr preferably in an amount of 6 to 10 mole % of the total dicalboxylic ingredient in the polyester in view of water-dispersibility and water solubility in a subbing layer coating solution and in view of water resisting qualities of a coating film.

Futher, in order to improve water-resisting qualities and adhesive properties, it is preferable to modify a styrene polymer.

Further, the styrene polymer may either be a homopolymer or a copolymer produced from the monomers given below.

A styrene such as styrene, methyl styrene, dimethyl styrene, trimethyl styrene, ethyl styrene, iso-propyl styrene, butyl styrene, hexyl styrene, cyclohexyl styrene, chloromethyl styrene, acetoxymethyl styrene, methoxy styrene, chloro styrene, dichloro styrene, 2-bromo-4-trifluoromethyl styrene, vinyl benzoic acid and vinyl benzoic acid methyl ester.

In the present invention, styrene content of the copolymer is not less than 50 mole %, and more preferably, not less than 60mole %.

Further, it may be a copolymer produced from the above-mentioned monomers and one or more monomers given below:

For example, acrylic acid esters, acrylamides, methacrylic acid esters, methacrylamides, allyl compounds, vinyl ethers, vinyl esters, vinyl heterocyclic compounds, N-vinyl compounds, chrotonic acid compounds, itaconic acid compounds, olefins and maleic acid anhydrides can be mentioned.

As more specific examples, acrylic acids such as acrylic acid; acrylates such as ethyl acrylate, butyl acrylate, amyl acrylate, octyl acrylate, 2-butoxyethyl acrylate, chloroethyl acrylate, cyanoethyl acrylate, dimethylaminoethyl acrylate, diethyleneglycol-mono acrylate, trimethylolpropane-monoacrylate, glycidyl acrylate, benzyl acrylate, and methoxybenzyl acrylate, methacrylic acids such as methacrylic acid, methacrylates such as methyl methacrylate, ethyl methacrylate, isopropyl methacrylate, benzyl methacrylate, cyanoacetoxyethyl methacrylate, chlorobenzyl methacrylate, ethyleneglycolmono methacrylate, 3-hydroxypropyl methacrylate, 2,2-dimethyl-3-hydroxypropyl methacrylate, diethylene glycol monomethacrylate, glycidyl methacrylate, dimethylaminophenoxyethyl methacrylate and phenyl methacrylate, acrylamides such as acrylamide, N-substituted acrylamides such as methyl acrylamide, ethyl acrylamide, butyl acrylamide, t-octyl acrylamide, benzyl acrylamide, dimethylaminoethyl acrylamide, phenyl acrylamide, hydroxyphenyl acrylamide, dimethyl acrylamide, dibutyl acrylamide, methacrylamides such as methacrylamide, N-substituted methacrylamide such as methyl methacrylamide, t-butyl methacrylamide, t-octyl methacrylamide, benzyl methacrylamide and cyclohexyl methacrylamide, allyl compounds, for example, allyl esters such as allyl acetate, allylcaprate and allyl laurate; allyloxy ethanol, allylbutyl ether, allylglycidyl ether and allylphenyl ether; vinyl ethers such as methylvinyl ether, butylvinyl ether, hexylvinyl ether, octylvinyl ether, ethylhexylvinyl ether, methoxyethylvinyl ether, chloroethylvinyl ether, 2-ethylbutyl ether and hydroxyethylvinyl ether; vinyl esters such as vinyl acetate, vinyl propionate, vinyl butylate, vinyl isobutylate, vinyldimethyl propionate, vinylethyl butylate, vinyl valerate, vinyl caproate and vinylchloroacetate, vinylheterocyclic compounds such as N-vinyl oxazolidone, vinyl pyridine, N-vinyl imidazole, N-vinyl pyrrolidone, N-vinyl carbazole, and n-vinylethyl acetamide, crotonic acid compounds such as crotonic acid, croton amide, crotonic acid ester such as butyl crotonate, vinyl ketones such as methylvinyl ketone and phenylvinyl ketone; olefins such as dicyclopentadiene diene, ethylene, propylene, 1-butene, 1-pentene, 1-hexene, 1-heptene and 1-octene, itaconic acids such as itaconic acid, itaconic acid anhydride and methyl itaconate, crotonic acids such as crotonamide and methyl crotonate, sorbic acid, cinnamic acid, methyl sorbate, glycidyl sorbate, citraconic acid, chloro acrylate, mesaconic acid, maleic acid and fumaric acid, unsaturated nitriles such as acrylonitrile and methacrylonitrile can be mentioned.

In the copolymer of the present invention, a styrene as a monomer unit is preferably contained in an amount of not less than 50 mole % and more preferably, of not less than 60 mole %.

Method of conducting dispersion polymerization of the above-mentioned styrene and other monomers capable of copolymerization with styrene in the presence of a polyester is as follows. More specifically, the above-mentioned monomer is dispersed in the solution containing polyester, and then, the above-mentioned monomer is polymerized at a temperature of 30° to 100° C. and, more preferably, of 50° to 80° C., using as a polymerization initiator such as ammonium persulfate, potassium persulfate, ammonium cerium nitrite, ammonium cesium sulfate, hydrogen peroxide, azobisisobutyronitrine or a benzoyl peroxide. In this case, a surface active agent is not always necessary and the above-mentioned monomer is capable of polymerization under the soap free condition, however, for the purpose of improving polymerization stability, a general nonionic or anionic surface active agent may be used as an emulsifying agent.

Further, a graft polymer composed of the water dispersible polyester and styrene or styrene and a monomer being capable of copolymerization with styrene, may be obtained according to copolymerization of the above-mentioned monnomer and the polyester denatured by introducing a reactive group being capable of addition polymerization in the end group of the polyester, or a method, in which first, polymerizing the above-mentioned styrene, and then, during a end group of the above-mentioned styrene, is active, introducing a reactive group such as a hydroxyl group, an amino group, a carboxyl group, a glycidyl group or an amino group and introducing this copolymer when the condensation reaction takes place.

In addition, a polymerization of styrene by using a polymerization catalyst is finished, and during an end group of the styrene polymer is still active, a compound having a hydroxyl group, an amino group, a carboxyl group, a halogen atom, a halogenated alcohol compound such as 4-bromophenetyl alcohol, 4-chlorophenol, 3-bromo-1-propanol or a halogenated carboxylic acid such as α-bromotoluilic acid, p-bromo-benzoic acid or 2-bromo-propionic acid are added in a reaction vessel, and reacted for about one hour at a temperature of 30° to 80° C. in a reaction vessel. Thus, the above-mentioned graft polymer can be also obtained.

The component ratio of polyester to styrene in the copolymer is 99:1 to 5:95, preferably, 97:3 to 50:50 and more preferably, 95:5 to 80:20 by weight.

Next, the polymer subbing layer used in the present invention is explained.

The polymer layer is used as a first subbing layer, and for the polymer diene-type rubber-like material is preferably used as the polymer. This rubber-like material is usually composed of a copolymer consisting of a vinyl monomer and a diolefin monomer. For the vinyl monomer, for example, styrene, acrylonitrile, methacrylonitrile, methyl methacrylate, methyl acrylate, vinyl acetate and as for diolefin, butadiene, isoprene and chloroprene are used preferably. In addition to these ingredients, as for unsaturated carboxylic acid, such as acrylic acid, methacrylic acid, itaconic acid, maleic acid anhydride or a derivative in which a part of these ingredients are alkylesterified; acrolein, methacrolein, glycidyl acrylate, glycidyl methacrylate, 2-hydroxyethyl acrylate, 2-hydroxyethyl methacrylate, allyl acrylate, allyl methacrylate, an ingredient being capable of crosslinking such as N-methylol acrylamide, N-methylol methacrylamide, vinyl isocyanate and allyl isocyanate may preferably be added. The content of diolefin is preferably 10 to 60% by weight with respect to the total polymer.

For the copolymers, which are preferable in view of easy availability on the market, for example, styrene-butadiene, styrene-isoprene, styrene-chloroprene, methylmethacrylate-butadiene and acrylonitrile-butadiene can be mentioned. Among these, styrene-butadiene is preferably employed.

For the method of polymerization, for example, emulsion polymerization, solution polymerization, bulk polymerization suspension polymerization and radioactive polymerization, etc. can be mentioned.

In the present invention, the diene monomer which is a monomer constituent forming the copolymer, denotes a monomer containing two ethylenic linkages in a molecule, and the diene monomer may be either an aliphatic unsaturated hydrocarbon or one having a cyclic structure. Specifically, it includes, for example, conjugated dienes such as butadiene, isoprene and chloroprene; non-conjugated dienes such as 1,4-pentadiene, 1,4-hexadiene, 3-vinyl-1,5-hexadiene, 1,5-hexadiene, 3-methyl-1,5-hexadiene, 3,4-dimethyl-1,5-hexadiene, 1,2-divinylcyclobutane, 1,6-heptadiene, 3,5-diethyl-1,5-heptadiene, 4-cyclohexyl-1,6-heptadiene, 3-(4-pentenyl)-1-cyclopentene, 1,7-octadiene, 1,8-nonadiene, 1,9-decadiene, 1,9-octadecadiene, 1-cis-9-cis-1,2-octadecatriene, 1,10-undecadiene, 1,11-dodecadiene, 1,12-tridecadiene,1,13-tetradecadiene, 1,14-pentadecadiene, 1,15-hexadecadiene, 1,17-octadecadiene and 1,21-docosadiene can be mentioned. Among these olefin monomers, conjugated dienes such as butadiene, isoprene and chloroprene may preferably be used and, particularly, butadiene is employed advantageously.

In the present invention, for the styrene derivative, which is another monomer being capable of forming the copolymer, for example, methylstyrene, dimethyl styrene, ethyl styrene, diethylstyrene, isopropyl styrene, butyl styrene, hexyl styrene, cyclohexyl styrene, decyl styrene, benzyl styrene, chloromethyl styrene, trifluoromethyl styrene, ethoxymethyl styrene, acetoxymethyl styrene, methoxy styrene, 4-methoxy-3-methyl styrene, dimethoxy styrene, chloro styrene, dichloro styrene, trichloro styrene, tetrachloro styrene, pentachloro styrene, bromo styrene, dibromo styrene, iodo styrene, fluoro styrene, trifluoro styrene, 2-bromo-4-trifluoro styrene, 4-fluoro-3-trifluoromethyl styrene, vinyl benzoic acid, and vinyl methyl benzoate can be mentioned. styrene, The content of the diolefin monomer in the copolymer according to the present invention is preferably 10 to 60% by weight and, particularly, 15 to 40% by weight of the total copolymer.

Particularly, it is preferable that the content of styrene is 70 to 40% by weight of the total copolymer.

Further, for the monomer containing two or more vinyl group, acryloyl group, methacryloyl group or allyl group in the molecule, for example, divinyl benzene, 1,5-hexadiene-3-in, hexatriene, divinyl ether, divinylsulfone, diallyl phthalate, diallyl carbinol, diethylene glycol dimethacrylate, trimethylolpropane trimethacrylate and trimethylolpropane dimethacrylate, which are known as a linking agent added on the polymerization of a vinyl monomer, can be mentioned.

The copolymer used in the present invention is a latex, the gel fraction of which is 50 to 95% by weight.

Herein the term "gel" denotes a copolymer in which copolymer constituents are polymerized in three dimensions. When a copolymer ingredients are copolymerize three-dimensionally as the copolymer according to the present invention, solubility of the copolymer to a solvent varies depending on the degree of three dimensional polymerization. That is to say, the higher the degree of three dimensional polymerization is, the lower becomes the solubility of the copolymer in the solvent. Accordingly, the degree of three-dimensional polymerization ma be assumed from its solubility.

Of course, since the solubility varies depending on the solvent to be used, and, therefore, the definition of the three-dimensional polymerization varies depending on the solvent, however, in the present invention, the term "gel" denotes the state of polymerization in tree dimensions and the degree of the three-dimensional polymerization is to an extent, under which the polymer is not soluble in tetrahydrofurane when it is dipped in it at 20° C. for 48 hours.

The polymerization method of diene-type polymers are disclosed in detail, for example, in U.S. Pat. Nos. 2,852,386, 2,853,4547, 3,411,911, 3,411,912, and 4,197,127; Belgian Patent Nos.688,882, 691,360 and 712,823; Japanese Patent Examined Publication No. 5331(1970); Japanese Patent O.P.I. Publication Nos. 18540(1985), 130217(1976), 137831 (1983) and 50240(1980).

The average particle size of the diene-type polymers is preferably 0.005 to 2.0 μm and, particularly preferably 0.01 to 0.8 μm.

In the case of the diene-type polymers polymerized in the organic solvent, It can be employed by dispersing the polymer in water and replacing the organic solvent with water under the condition of reducing pressure.

The polymer used in the first subbing layer is prepared as an aqueous dispersion (latex), and, if necessary, it is preferable to this aqueous dispersion a necessary additive including, for example, a crosslingking agent, a surface active agent, a swelling agent, a matting agent, and an antistatic agent. For the crosslingking agent, for example, triazine compounds disclosed in U.S. Pat. Nos, 3,325,28, 3,288,775 and 3,549,377 and Belgian Patent Nos. 6,602, 226; dialdehyde type compounds disclosed in U.S. Pat. Nos. 3,291,624 and 3,232,764; French Patent No. 1,543,694 and British Patent No. 1,270,578; epoxy compounds disclosed in U.S. Pat. No. 3,091,537 and Japanese Patent Examined Publication No. 49-26580(1974); vinyl-type compounds disclosed in U.S. Pat. No. 3,642,486; aziridine-type compounds disclosed in U.S. Pat. No. 3,392,024; ethyleneimine-type compounds disclosed in U.S. Pat. No. 3,549,378 and methylol-type compounds can be mentioned. Among these compounds, dichlorotriazine derivatives are preferable.

In the first subbing layer according to the present invention, it is preferable that a water-soluble polymer is incorporated for the purpose of improving coating performance.

As for the water-soluble polymer, for example, hydroxyethyl cellulose(HEC), carboxymethyl cellulose(CMC), methyl cellulose(MC), hydroxypropylmethyl cellulose (HPMC), ethylhydroxyethyl cellulose(EHEC), modified hydroxyethyl cellulose(HMHEC),poly(vinyl pyrrolidone) (PVP), polyethylene oxide(PEO), xanthane, cationic hydroxyethyl cellulose(CATHEC), polyvinyl alcohol(PVA), poly(acrylamide), sodium alginate and carbopol(registered trademark) acrylamide viscosity-increasing composition can be mentioned. The water-soluble polymer of the present invention have a water-solubility of not less than 0.1 % by weight at a temperature of 25° C., and it is preferable that the water-soluble polymer is contained in an amount of 0.5 to 5% by weight of the subbing layer.

Sodium carboxymethyl cellulose(CMC) which is useful to practice the present invention can be obtained from various materials. One example is CMC-7LX(a product of Aqualon Ltd., Wilminton, Del.). This product usually shows aqueous viscosity of 200 to 1000 mPa.s under an aqueous 5% concentration by weight and carboxymethyl substitution degree of 0.65 to 0.80. Needless to say that these other kinds of CMC, which are applicable to the present invention, has wide molecular weight range and various carboxymethyl substitution degrees.

Methyl cellulose(MC) and hydroxyethyl cellulose(HEC) are sold by Aqualon Company, ethylhydroxy cellulose is sold by Berol Nobel, and hydroxypropylmethyl cellulose is sold by Aqualon Company and Dow Chemical Company.

Next, the compound by represented by Formula I is explained in detail.

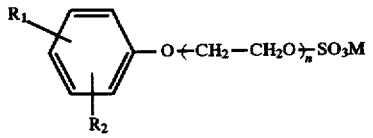

Formula 1 wherein $R_1$ and $R_2$ each represents a straight or an branched alkyl group having a carbon number of 1 to 18, M represents a cation, and n represents an integer of 1 to 50.

The compound represented by Formula I of present invention is an alkylarylpolyethersulfate compound and, when a specific balance between the number of carbon atoms in the alkyl group introduced into the aryl group and the polymerization degree of the polyether structure, is attained, preferable surface activity and preferable emulsion stability can be obtained, so that the smooth and uniform film-forming property of the subbing layer are achieved.

As for the alkyl group represented by $R_1$ and $R_2$ in Formula 1, a branched alkyl group is preferably employed, and two branched alkyl groups is particularly preferably employed.

The cation represented by M may be optional so far as it does not jeopardise the surface activity and the water-solubility of the compound, however, potassium, sodium and ammonium ions are usually employed.

Further, n is preferbly an integer of 1 to 30, and more preferably, of 1 to 13.

Below, specific representative compounds represented by Formula [I] are given, however, the scope of the invention is not limited by these.

I-1

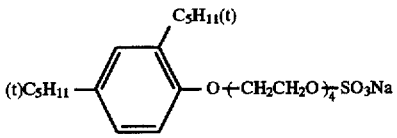

I-2

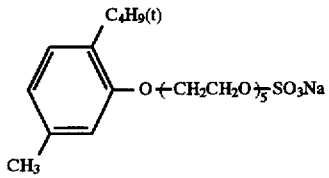

I-3

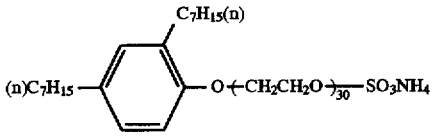

I-4

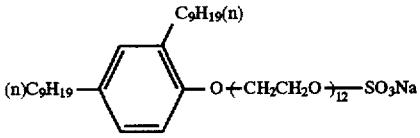

I-5

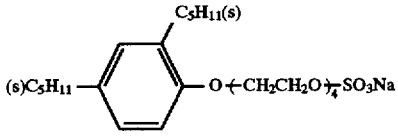

I-6

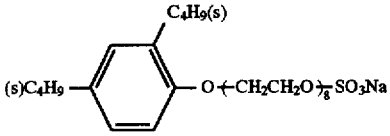

I-7

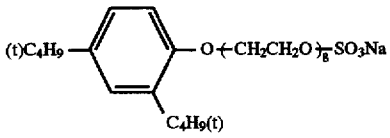

I-8

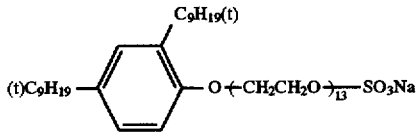

I-9

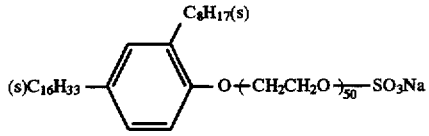

As for the electrically conductive compounds which can be incorporated in the subbing layer according to the present invention, for example, polymers or copolymers having a structural unit represented by Formula 2, can be mentioned as given below.

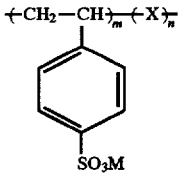

Formula 2

In the formula, m and n each represents an integer; M represents a hydrogen atom, an alkaline metal or an alkaline earth metal and X represents other monomer being capable of copolymerization.

As for the other monomer capable of copolymerization, for example, a styrene compound such as styrene, α-methytlstyrene, vinyltoluene and p-methylstyrene; acrylic esters such as methyl acrylate, ethyl acrylate, butyl acrylate, 2-ethylhexyl acrylate, methyl methacrylate, 2-hydroxyethyl acrylate and 2-hydroxyethyl methacrylate; a mono- or di-carboxylic acid anhydride such as acrylic acid, methacrylic acid, crotonic acid, maleic acid, fumaric acid and itaconic acid; an aliphatic conjugated diene such as butadiene, isoprene, 2-chloro-1,3-butadiene and 1-chloro-1,3-butadiene; a vinyl cyano compound such as acrylonitrile and methacrylonitrile; vinyl chloride, vinylidene chloride, vinylethylketone, vinylmethylether, vinyl acetate, vinyl formate, allyl acetate, methaallyl acetate, acrylamide, N-methylol acrylamide, glycidyl acrylate, glycidyl methacrylate, acrolein and allyl alcohol can be mentioned.

In the present invention, it is preferable in the view of anti-static property, transparency and adhesion property of the support that the electrically conductive compound preferably contains the other monomer capable of copolymerization in an amount of 10 to 50 mole %. Although there is no specific limitation as to the number average molecular weight of the polymeric compound measured by GPC (Gel Permeation Chromatography), however, in the view of transparency after biaxial stretching, it is preferably 500 to 1,000,000 and, more preferably, 1,000 to 10,000. In the present invention, the electrically conductive compound is added at the time of preparing a coating solution.

As for the counter ion for the sulfonic acid in the structural unit, for example, $H^+$, $Na^+$, $K^+$, $NH_4^+$, $Li^+$ and ½ $Ca^+$ may be mentioned and, among these, $H^+$ and $NH_4^+$ are preferable in view of anti-static property and transparency.

Polyglycerin incorporated in the subbing layer composition according to the present invention, a compound represented by the formula is preferable.

$$HO(CH_2CH(OH)CH_2O)_nH \ (2 \leqq n \leqq 20)$$

In the present invention, polyglycerin is contained in an amount of 0.01 to 50% by weight, and more preferably, of 5 to 40% by weight of the total solid ingredients of the subbing layer composition prepared in the weight ratio of the electrically conductive compound to the polymeric composition containing polyester and a styrene polymer as the structural constituents, being 70 to 15:30 to 85.

By incorporating poly glycerin in the subbing layer composition, it becomes possible to prevent coagulation or gelation of said composition, and the preferable transparency may be achieved.

In addition, in the subbing layer composition according to the present invention may comprise an anionic surface active agent, a nonionic surface active agent, an aliphatic polyhydroxyl compound, a sulfonated compound of a natural water-soluble polymer, a carboxylation compound of a natural water-soluble polymer, a phosphoration compound of a natural water-soluble polymer, a sulfoalkylation compound of a natural water-soluble polymer, a alkylphosphoration compound of a natural water-soluble polymer or a salt thereof, an anti-blocking agent an organic or inorganic filler, a pigment, or an ultraviolet-ray absorbent within the range which does not fail to the advantage of the present invention.

Coating of the subbing layer may be carried out after film-manufacturing process, however, if stretching of the subbing layer composition is possible, it may be carried out at an optional step such as a period prior to stretching in the longitudinal direction during the film-making process, at a period between stretching in the longitudinal direction and stretching in the lateral direction, or a period prior to heat treatment after stretching in the lateral direction.

It is preferable that the film strength of the subbing layer composition is enhanced by using a hardening agent, including, for example, aldehyde-type, aziridine-type, isooxazole-type, epoxy-type, vinylsulfon-type, acryloyl-type, carbodiimide-type, triazine-type, polymer-type, maleimide-type, acetyrene-type, or methanesulfonate-type h hardening agent.

The first subbing layer according to the present invention can be manufactured by coating a coating solution, in which coating composition according to the present invention is mixed, on the SPS film and drying it.

The coated amount of the polymer used in the first subbing layer is preferably 100 to 1000 mg per square meter and the drying temperature of the subbing layer is set at 80° to 200° C. and, more preferably, 80° to 140° C.

Further, it is preferable that this first subbing layer is provided within film-making step of the SPS film, or it is provided by coating on a film before completion of crystal orientation, and, subsequently, by carrying out stretching, heat-fixation and completing crystal orientation.

In the present invention, the term "a film before completion of crystal orientation" means an unstretched film prepared by steps of a heat-melting step of a polymer and a film manufacturing step or an incompletely stretched film not having not a final stretching magnification such as a mono-axially stretched film which has been stretched only in longitudinal or lateral direction or an incompletely biaxially stretched film, wherein a further stretching in both longitudinal and lateral directions is carried out, so that the crystallization by orientation is completely finished.

The concentration of this coating solution is usually not more than 20% by weight and, more preferably, not more than 15% by weight. Moreover, the coated amount is preferably 1 to 20 g and more preferably, 5 to 15 g per 1 square meter of the film by the weight of the coating solution.

As for coating method, various conventional coating methods can be employed. For example, a roll-coating method, a gravure-roll coating method, a spray coating method, an air-knife coating method, a bar coating method, a dip coating method and a curtain coating method can be used either individually or in combination.

Incidentally, SPS film has a specific feature that dielectric loss is small. For this reason, it has a characteristic feature that once it is charged, it is hardly discharged naturally.

Accordingly, a subbing layer coating condition is changed depending on the electric charge distribution, so that it is tend to occur uneven coating. Therefore, it is preferable to discharge by force before and after coating the subbing layer coating solution.

The discharging method which is preferably applied to the present invention, includes, for example, a method of grounding rolls being contact with the transporting support, a method of spraying water vaporized by applying ultrasonic waves, a method of neutralizing electric charge by generating ionized air with radioactive irradiation; a method of using a discharging brush; an applying high voltage method and a bomabarding ionized wind method.

Further, when providing the first subbing layer, immediately before coating, the following surface treatments are preferably employed.

This is because the SPS film has highly hydrophobic surface. In order to overcome this sort of problems, after surface activation treatment such as chemical treatment, mechanical treatment, corona discharge, flame treatment, ultra-violet-rays treatment, high frequency electromagnetic waves treatment, glow discharge treatment, active plasma treatment, laser treatment, mixed acis treatment or ozone oxidation treatment is carried out, the first subbing layer is provided, and, thereafter, a silver halide photographic sensitie emulsion layer is coated thereon. Among these treatments, corona discharge treatment, flame treatment and glow discharge treatment are particularly preferable.

Further, the surface tension of the support is preferably 50 to 70 dyn/cm.

Among these preferable surface treatments, the corona discharge treatment can be carried out with reference to the methods disclosed in, for example, Japanese Patent Examined Publication No. 48-5043(1973) and 47-51905(1972); Japanese Patent O.P.I. Publication Nos. 47-28067(1972), 49-83767(1974) 51-41770(1976), and 51-131576(1976). Discharge frequency is preferably 50 to 5000 KHz and, more preferably, 5 to several hundred KHz. If the discharging frequency is too low, stable discharge property may hardly be obtainable. It is also unpreferable that pinholes tend to be occurred on the subject. When, on the other hand, the frequency is to high, a special equipment for adjusting impedance may be required and this is unpreferable because it raises the price of the equipment. As regards treatment strength of the subject, it is 0.001 to 5 kV.A.min./$m^2$ and, more preferably 0.01 to 1 kV.A.min./$m^2$. Further, gap-clearance between the electrode and the electro-inductive roll is generally 0.5 to 2.5 mm and, more preferably, 1.0 to 2.0 mm.

Grow discharge treatment, which is another preferable surface treatment may be carried out with reference to the method disclosed in, for example, Japanese Patent Examined Publication Nos. 35-7578(1960), 36-10336(1961), 45-22004(1970), 45-22005(1970), 45-24040(1970) and 46-43480(1971); U.S. Pat. Nos. 3,057,792, 3,057,795, 3,179,482, 3,288,638, 3,309,299, 3,424,735, 3,462,335, 3,475,307 and 3,761,299; British Patent No. 997,093 and Japanese Patent O.P.I. Publication No. 53-129262(1978).

As discharging frequency, as known in the art, it is the direct current to several thousand MHz and, preferably, 50 to 20 MHz. As regards strength of the discharging treatment, it is 0.01 to 5 kV.A.min./$m^2$ and, preferably 0.15 to 1 kV.A.min./$m^2$in the view to obtaining enhanced adhesion. Further, ultra-violet ray irradiation treatment, which is especially advantageous for the pre-treatment of the organic solvent-type subbing treatment, any one of the methods which are known in the art can be used. For example, those methods disclosed in the Japanese Patent Examinee Publication Nos. 39-14534(1964), 39-16094(1964) and 45-3828 (1970) can be used.

The surrounding gas composition at the time of glow discharge treatment has partial water vapor pressure of not less than 10 and not more than 100% and, more preferably, of not less than 40 and not less than 90%. Other gas than the water vapor consists of an air comprising oxygen, nitrogen, etc. The manner of quantitatively introducing the water vapor into the atmosphere can be attained by introducing the gas from a sampling tube attached to the glow discharging device to quadropole mass spetrometer(type MSQ-6150, a product of Nihon Shinkuu Co., Ltd.), and by analyzing the composition of the gas.

When the glow discharge treatment is carried out while heating the support to be subject to surface treatment, the adhesion property can be improved in a short period of time and yellow stain occurence of the support can be reduced to a considerable degree. The pre-heating temperature, in this case, is set to be not less than 50° C. and not more than the glass transition temperature(Tg) of the support, more preferably, not less than 70° C. and not more than Tg, and more preferably, not less than 90° C. and not more than Tg. For the specific method of raising the polymer surface temperature in the vacuum, for example, heating by the use of a infra-red ray heater and heating by getting the support into contact with a heat roller, can be mentioned.

It is preferable that the glow discharge treatment is carried out by providing electrodes having a intermediate area as a cooling flow path in the lateral direction of the film while transporting the support.

Discharging frequency is the direct current to several thousands MHz, preferably, 50 Hz to 20 MHz, more preferably, 1 KHz to 1 MHz.

The discharging treatment strength is preferably 0.01 to 5 kV.A.min/$m^2$ and, more preferably, 0.15 to 1 kV.A.min./$m^2$.

It is preferable that the support to which glow discharge treatment has been completed is immediately cooled down its temperature by the use of a cooling roll, as disclosed in Japanese Patent O.P.I. Publication No. 3-39106(1991).

It is preferable that the treatment with ultra-violet ray-irradiation is carried out in accordance with the methods disclosed in Japanese Patent Examined Publication Nos. 43-2603(1968), 43-2604(1968) and 45-3828(1970). As a mercury lamp, a high pressure mercury lamp, which is made of quartz tube and wave length range of ultraviolet rays is preferably 180 to 380 nm. Irradiation of the ultraviolet rays may be performed either during the stretching step of the support, at the time of thermal fixing or after thereof.

Concerning the manner of ultraviolet rays irradiation, if no problems are caused when the surface temperature of the support is risen up to about to 150° C., then a high pressure mercury lamp having the main wavelength of 365 nm can be employed. In the case where treatment at low temperatures is required, then, a low pressure mercury lamp having the main wavelength of 254 nm may preferably be used. it is also possible to use an ozoneless-type high pressure mercury lamp or a low pressure mercury lamp.

For the preferable manner of practicing irradiation, the irradiation amount of 20 to 10000 mJ/$cm^2$ with a high pressure mercury lamp habing the main wavelength of 365 nm is preferable and, more preferably, 50 to 2000 mJ/$cm^2$. In the case that a low pressure mercury lamp having the main irradiation wavelength of 254 nm is used, the irradiation amount is preferably 100 to 10000 mJ/$cm^2$ and, more preferably, 300 to 1500 mJ/$cm^2$. Treatment can be performed with reference to the methods disclosed, for example, in Japanese Patent Examined Publication Nos. 39-12838(1964), Japanese Patent O.P.I. Publication Nos. 47-19824(1972), 48-28067(1973) and 52-42114(1977).

Gas to used for flame treatment can be any one of natural gas, liquid propane gas and city gas, however, mixing ratio with the air is important. This is because the effects of the fire-flame treatment is considered to be brought by plasma containing active oxygen and there are two important features, that is to say, activity(temperature) of the plasma and the oxygen content The decisive factor of the two features is the gas/oxygen ratio and when the gas reacts with oxygen neither too much nor too little, energy concentration becomes maximum and the activity of the plasma the highest. To be more specific, preferable mixing ratio of the natural gas/air in terms of volume is between 1/6 and 1/10 and, more preferably, between 1/7 and 1/9; In the case of liquid propane gas/air it is between 1/14 and 1/22 and, more preferably, 1/16 and 1/19 and between 1/2 and 1/8 and, more preferably between 1/3 and 1/7 in the case of town gas/air.

Amount of flame treatment is generally 1 to 50 kcal/$m^2$and, more preferably 3 to 20kcal/$m^2$. Distance between the front edge of the inner flame of the burner and the support is generally 3 to 7 cm and, more preferably, 40 to 6 cm. As the shape of the nozzle(s) of the burner, ribbon-type (by Flynn Burner, the U.S.), multi-hole type(by the Wise Ltd., the U.S.), ribbon-type(by Aerogen Ltd,, the U.K.), multi-hole in zigzag arrangement(by Kasuga Electric Co. Ltd., Japan) or zigzag multi-hole type(by Koike Oxygen Co.,Ltd., Japan) is preferable. Back-up roll which sustains the support is preferably made of a hollow cylinder roll, water-cooled so that the treatment can be performed at a predetermined temperature.

In the present invention, it is preferable to provide a hydrophilic colloidal layer on the subbing layer. As for the hydrophilic polymer used in the present invention, for example, a polymer, a cellulose ester, a latex polymer and a polyester can be mentioned. The polymer includes, for example, gelatin, a gelatin derivative, casein, agar, sodium arginate, starch, polyvinyl alcohol, polyacrylicacid copolymer and maleic acid anhydride copolymer can be mentioned. As for cellulose ester, carboxymethyl cellulose, hydroxyethyl cellulose, etc. can be mentioned. As for the latex polymer, for example, a copolymer containing vinyl chloride, a copolymer containing vinylidene chloride, a copolymer containing acrylate, a copolymer containing vinyl acetate, and a copolymer containing butadiene can be mentioned. Among these the most preferable hydrophilic polymer is gelatin. As for gelatin, any one which is usually used in the art can be used, including, for example a lime-treated gelatin, an acid-treated gelatin, an oxygen-treated gelatin, gelatin derivative and modified gelatin. Among these, the most popularly used are a lime-treated gelatin and an acid-treated gelatin. These gelatin may comprise various kinds of impurities which are incorporated in the manufacturing steps thereof, including, for example 0.01 to 20,000 ppm of metals or an ion thereof,(such as Na, K, Li, Rb, Ca, Mg, Ba, Ce, Fe, Sn, Pb, Al, Si, Ti, Au, Ag, Zu and Ni); an ion (such as F, Cl, Br, I, a sulfate ion, a nitrate ion, an acetate ion, and an ammonium ion. Particularly, it is well known in the art that the lime-treated gelatin contains calcium and magnesium ions. The content of these ions is usually to 10 to 3,000 ppm, preferably not more than 1000 ppm and, still more preferably, not more than 500 ppm in the view of properties of the subbing layer The subbing solution can contain, if necessary, a variety of additives including, for example, a surface active agent, an anti-static agent, an anti-halation agent, a coloring dye, a pigment, a coating aid and an anti-foggant in addition to the above-mentioned.

As for gelatin hardener, for example a chromium salt such as chromium alunite; an aldehyde compound such as formaldehyde and glutaraldehyde; an isocyanate, an epichlorohydrin resin, polyamide-epichlorohydrin resin (as disclosed in Japanese Patent Examined Publication No. 49-26580 (1974) and Japanese Patent O.P.I. Publication No. 51-3619 (1976); a cyanuric chloride compound such as those disclosed in Japanese Patent O.P.I. Publication Nos. 47-6151 (1972), 47-33380(1972), 54-25411(1983) and 56-130740 (1981); a vinylsulfone or a sulfonyl compound such as those disclosed in Japanese Patent Examined Publication Nos. 47-24259,(1972) and 50-35807(1975), Japanese Patent O.P.I. Publication Nos. 49-24435(1974), 53-41221(1978) and 59-18944(1984); a carbamoyl ammonium salt compound such as those disclosed in Japanese Patent publication Nos. 56-12853(1981) and 58-32699(1983), Japanese Patent O.P.I. Publication Nos. 49-51945(1974), 51-59625(1976)

and 61-9641(1986); an amidinium-type compound such as those disclosed in Japanese Patent O.P.I. Publication Nos. 61-225148(1986); a carbodiimide-type compound such as those disclosed in Japanese Patent O.P.I. Publication Nos. 65-126125(1990) and 52-48311(1977); a pyridiniuym salt-type compound such as those disclosed in Japanese Patent Publication No. 58-50699(1983), Japanese Patent O.P.I. Publication Nos. 52-544427(1977), 57-44140(1982) and 57-46538(1982) and other compounds such as those disclosed in Belgian Patent No. 825,726, U.S. Pat. No. 3,321, 313, Japanese Patent O.P.I. Publication Nos. 50-38540 (1975), 52-93470(1977), 56-43353(1981) and 58-113929 (1983) can be mentioned.

In the subbing layer according to the present invention, organic or inorganic fine particles can be incorporated as matting agent within the extent which does not jeopardise transparency or graininess of the image to be produced.

As inorganic matting agent, for example, silica dioxide, titanium dioxide, calcium carbonate, and magnesium carbonate can be used.

As organic fine particle matting agent, for example, polymethyl methacrylate, cellulose acetate propionate, polystyrene, a processing solution-soluble compounds disclosed in U.S., Pat. No. 4,142,894 and polymers disclosed in U.S. Pat. No. 4,396,706 can be used.

Average particle size of the above-mentioned fine particle matting agent is preferably 0.01 to 10 μm and, more preferably 0.05 to 5 μm, and the fine particle matting agent is preferably contained in an amount of 0.5 to 600 mg/m$^2$ and, more preferably, 1 to 400 mg/m$^2$ of the subbing layer.

The subbed film thus obtained is subsequently provided with the layers in order according to the manner mentioned above, adhesive property may further be improved by passing through a heat treatment mentioned below. As the first heat treatment process, it is carried out at a temperature of 40° C. to the glass transition temperature(Tg) of the support for the period for 0.1 minute to 1500 hours after the sublayer has been coated or before the silver halide emulsion layer has been coated. The adhesive property is improved by this treatment.

The second heat treatment method can be carried out by treating the subbed support, which was once subjected to heat treatment at a temperature of not less than the transition point(Tg) of the support and less than the melting temperature (melting temperature measured by DSC) thereof, is again subjected to heat treatment at the temperature of not less than above-mentioned 40° C. and less than the glasstransition temperature(Tg).

The above-mentioned heat treatment is preferably carried out at the temperature of not less than the transition temperature(Tg) and less than the melting temperature, and more preferably, not less than Tg plus 20° C. and less than the crystallizing temperature of the support(measured by DSC). The heat treatment may also be performed at a pre-determined temperature within the above-mentioned temperature range(pre-heat treatment). Or this may be carried out while either decreasing(temperature-decreasing pre-heat treatment) or increasing the temperature(temperature-increasing pre-heat treatment).

Period of the heat treatment is 0.1 minute to 1500 hours and, more preferably, not less than 1 minute and less than 100 hours.

After this heat treatment, a post heat treatment is performed. From the temperature at the time of completion of this heat treatment to the initial temperature of the post heat treatment, rapid cooling may be done or gradually cooling may be done through the glasstransition temperature of the support to the initial temperature of the post heat treatment. Further, after once cooling down to the room temperature, it may be raised to the temperature of the post heat treatment.

The post hear treatment may be carried out at the temperature of not less than 40° C. and less than the glasstransition temperature of the support and, more preferably, not less than 20° C. and less than the glasstransition temperature (Tg).

The post heat treatment may be carried out at a fixed temperature of the above-mentioned temperature range, or it may also be carried out while cooling down or increasing the temperature. Among these the preferable embodiment is the heat treatment at the fixed temperature or the treatment while cooling down the temperature. In this case the average cooling rate is −0.01° to −20° C./hour and, more preferably, −0.1° to −5° C./hour. The period of this heat treatment is not less than 0.1 minute and not more than 1500 hours and, more preferably, not less than 0.5 minute and not more than 200 hours.

Although there are some preferable combinations of the pre-heat treatment and the post-heat treatment, it is preferable that, after the pre- heat treatment is conducted at the temperature of not less than the glasstransition temperature plus +20° C. and not more than the crystallizing temperature, post-heat treatment is carried out at the temperature of the glasstransition temperature of the support to the glasstransition temperature −20° C., while cooling down is carried out at a cooling rate of −0.1° to −5° C./hour.

The light-sensitive photographic material according to the present invention comprises at least one silver halide emulsion layer provided at least one surface of the support. For the silver halide emulsion to be used for the silver halide emulsion layer may optionally be selected from various types of silver halide emulsions which are commonly known and used in the art. Further the silver halide emulsion can undergo chemical sensitization using a conventional method and it may be sensitized optically to a desired wavelength range by the use of a sensitizing dye.

In this silver halide emulsion a variety of photographic additives including, for example, an anti-foggant, a hardener and a anti-oxidizing agent. For the binder for the silver halide emulsion, it is usually advantageous to use gelatin.

The silver halide emulsion layer can be enhanced its film strength by the use of a hardening agent and as for such hardening agent, for example, an aldehyde-type compound, an aziridine-type compound, an iso-oxazole-type compound, an epoxy-type compound, a vinylsulfonyl-type compound, an acryloyl-type compound, a carbodiimide-type compound, a triazine-type compound, a polymeric compound, a maleimide-type compound, an acetyrene-type compound, a methanesulfonic acid ester-type compound, can be used either individually or two or more kinds in combination. Further other photographic additives including, for example, a plasticizer, synthetic polymer latex which is not or sparsely soluble in water, a coupler, a coating aid, an anti-static agent, a formalin scavenger, a fluorescent whitening agent, a matting agent, a lubricant, an image stabilizer, a surface active agent, anti-color foggant, a development accelerator, a development retarder and a bleach accelerating agent can also be incorporated.

In the silver halide light-sensitive photographic material according to the present invention, a variety of hydrophilic colloidal layer can be provided in addition to the above-mentioned silver halide emulsion layer. Such hydrophilic colloidal layer includes, for example, a protective layer, a filtering layer, a back-coating layer, an anti-halation layer, an anti-irradiation layer and an intermediate layer, etc. can be mentioned.

EXAMPLE 1

[1] Synthesis Example of SPS

Polymerization Example 1

A SPS pellet was manufactured according to the method disclosed in Japanese Patent O.P.I. Publication No. 3-131843.

Polymerization example is described below, All the operations were carried out in the argon atmosphere in the germ-free chamber.

17.8 g (71 mmol) of cupric sulfate pentahydrate ($CuSO_4.5H_2O$), 200 ml of refined benzene and 24 ml of trimethyl aluminium were put in a glass vessel, of which inner volume is 500 ml, and agitated at 40° C. for eight hours.

After this was filtered with glass filter of No. 3A in the argon atmosphere, and the filtered solution was freeze-dried while it may not contact with the air.

Then, after the pressure was returned to the normal pressure under argon atmosphere, the produced material was taken out.

The produced material, tri-isobutyl aluminium pentamethylcyclopentadienyl titan trimethoxyd and pentadiethyl titan trimethoxyd were mixed, put into a stainless reaction vessel having the inner volume of 2 liters, and heated to 90° C. in an oil bath.

Then, 1 liter of sufficiently dehydrated and refined styrene and 70 ml of paramethyl styrene were added to this and the mixture was subjected to polymerization reaction at this temperature for 87 hours. Thereafter, one liter of methylene chloride was added, and adding a methanol solution of sodium methylate under agitation, the mixture was taken out of from the aseptic chamber (or germ-free chamber).

After this was added dropwise gradually into 20 liters of methanol, filtered with a glass filter of No. 3 and washed with 1 liter of methanol for three times, and this was dried under reduced pressure for 12 hours.

The weight average molecular weight measured by GPC and the glass transition temperature of the product were 430,000 and 98° C., respectively.

Polymerization Example-2

Polymerization was carried out in the similar manner as in polymerization Example-1, except that in stead of styrene, 930 ml of sufficiently hydrated and refined styrene and 70 ml of α-methylstyrene were used. The glass transition temperature in this case was 97° C.

After respective products were made into a pellet by extruding machine, these pellets were crystallized at a temperature of 130° C.

[2] Manufacture of the coating solution of the light-sensitive material

[Preparation of a coating solution for silver halide emulsion Em-1]

The following <Solution A>and <Solution B>were mixed by the control double-jet mixing for eleven minutes.

<Solution A>

| | |
|---|---|
| Gelatin | 5.6 g |
| 10% ethanol solution of $HO(CH_2CH_2O)n(CH_2CH_2CH_2O)_{17}(CH_2CH_2O)mH$ (m + n = 6) | 0.56 ml |
| Sodium chloride | 0.12 ml |
| Conc. nitric acid | 0.43 ml |
| Distilled Water | 445 ml |

<Solution B>

| | |
|---|---|
| Silver nitrate | 60 g |
| Conc. nitric acid | 0.208 ml |
| Distilled water | 85.2 ml |

<Solution C>

| | |
|---|---|
| Gelatin | 3 g |
| 10% ethanol solution of $HO(CH_2CH_2O)n(CH_2CH_2CH_2O)_{17}(CH_2CH_2O)mH$ (m + n = 6) | 0.3 ml |
| Sodium chloride | 20.2 g |
| Sodium hexachlorodium (1% aqueous solution) | 20 ml |
| Distilled water | 85.61 ml |

<Solution D>

| | |
|---|---|
| Gelatin | 3 g |
| 10% ethanol solution of $HO(CH_2CH_2O)m(CH_2CH_2CH_2O)_{17}(CH_2CH_2O)mH$ (m + n = 6) | 0.14 ml |
| Distilled water | 48.8 ml |

Average grain size of the thus obtained silver halide grains was 0.12 μm and the degree of mono-dispersity thereof was 8–15%. To the thus prepared emulsion, <Solution D>was added, and pH was adjusted at 6.0 with sodium carbonate and, subsequently, 200 mg of 4-hydroxy-6-methyl-1,3,3a,7-tetrazaindene was added. Thereafter, respective silver halide emulsions were washed and desalinated according to a conventional method and, then, <Solution E>was added as a preservative.

<Solution E>

| | |
|---|---|
| 2-methyl-5-chloroisothiazole-3-one | 15 mg |
| Pure water | 0.3 ml |

To the above emulsion, 200 mg of 4-hydroxy-6-methyl-1,3,3a,7-tetrazaindene as a stabilizer and 3.6 g of gelatin were added.

Further, the following additives were added to the coating solution, and added water to make the total volume of the coating solution to be 303 ml, to prepare the coating solution for silver halide emulsion Em-1.

| | |
|---|---|
| 33%(W/V) aqueous solution of saponin | 2.2 ml |
| 20%(W/V) aqueous solution of sodium dodecylbenzene sulfonate | 2.2 ml |
| 4%(W/V) aqueous solution of sodium 1-decyl-2-(3-isopentyl)succinate-2-sulfonate | 0.3 ml |
| 20%(W/V) emulsion solution of polymer latex (cyclohexylmethacrylate/isononylacrylate/glycidylacrylate/styrene-isoprene sulfonic acid) having an average particle size of 0.25 μm | 31.8 ml |
| 2%(W/V) methanol solution containing a hydrazine derivative (A-1) | 7.5 ml |
| 5%(W/V) aqueous solution containing an amine compound (A-2) | 4 ml |
| 7%(W/V) aqueous solution containing citric acid | 0.4 ml |
| 2%(W/V) aqueous solution containing a nonionic surface active agent(A-3) | 26.5 ml |

-continued

| | |
|---|---|
| 0.5%(W/V) alkaline aqueous solution containing 2-mercaptohypoxanthin | 4 ml |
| 5%(W/V) aqueous solution containing sodium ethylenediaminetetraacetic acid | 10 ml |
| 5%(W/V) methanol solution containing spirobis (3,3-dimethyl-5,6-dihydroxy indane) | 1.5 ml |
| 20%(W/V0 aqueous solution containing hydroquinone | 2.5 ml |
| 4%(W/V) aqueous solution containing a copolymer of styrene sulfonic acid and maleic acid | 4 ml |
| 5%(W/V) methanol solution containing 2-methyl-5-chloroisothiazole-3-one | 0.1 ml |

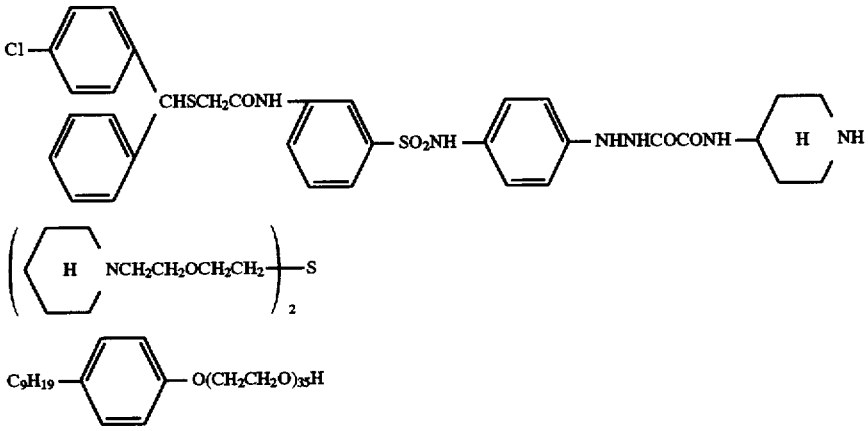

(A-1)

(A-2)

(A-3)

[Preparation of a coating solution for the protective layer P-1]

A coating solution for the protective layer P-1 was prepared by adding and mixing the following additives, and added pure water to make the total volume to be 1414 ml,

| | |
|---|---|
| 12%(W/V) aqueous solution containing gelatin | 250 ml |
| 4%(W/V) aqueous solution containing sodium 1-decyl-2-(3-isopentyl)succinate 2-sulfonic acid | 50 ml |
| 4%(W/V) solution of sodium | 50 ml |
| 10%(W/V) aqueous solution containing sodium chloride | 22 ml |
| Amorphous silica(average diameter: 3.5 μm) | 2 g |
| Amorphous silica(average diameter: 6 μm) | 4 g |
| 0.08%(wt) methanol solution containing an anionic surface active agent (A-4) | 70 ml |
| 7%(W/V) aqueous solution containing citric acid | 5.1 ml |
| 2%(W/V) methanol solution containing (dimezon S) | 20 ml |
| 2%(W/V) aqueous solution containing the dye (A-5) given below | 700 ml |
| 4%(W/V) aqueous solution containing a copolymer of styrene sulfonic acid and maleic acid | 22.7 ml |
| 0.1%(W/V) aqueous solution containing 2-bromo-2-nitro-1,3-propane diol | 6 ml |
| Dye dispersion Bu | 250 ml |

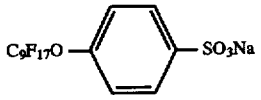

(A-4)

-continued

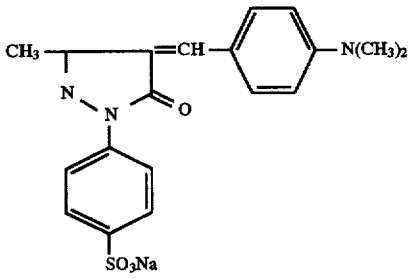

(A-5)

[Preparation of dye dispersion Bu]

After dispersing a dye(A-6) given below at a quantity equivalent to 100 mg/m$^2$ as coated, which was dissolved in 200 ml of ethyl acetate together with 30 g of gelatin, 147 mg of citric acid, 400 mg of isopropylnaphthalene sulfonic acid and 3 g of phenol dissolved in pure water and made 250 ml in total, in a PD dispersing machine, removed ethylacetate while heating the mixture under reduced pressure, added pure water to make the total volume to be 250 ml and cooled to set the mixture, to prepare a dye dispersion containing dye having average grain diameter of 0.2 μm.

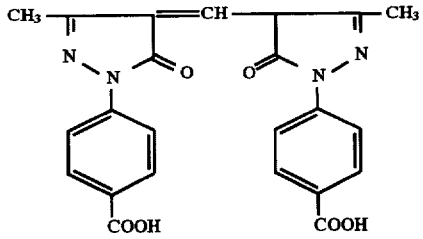

(A-6)

[Preparation of a coating solution for the backing layer BC-1]

A coating solution for the backing layer BC-1 was prepared by adding and mixing the additives given below, and adjusting with pure water so that the total volume became 895 ml.

| | |
|---|---|
| Gelatin | 32.4 g |
| Pure water | 696 ml |
| 6%(W/V) aqueous solution of dye (A-7) | 64 ml |
| 5%(W/V) aqueous solution of dye(A-8) | 24 ml |
| 33%(W/V) aqueous solution of saponin | 6.6 ml |
| 20%(W/V) polymer latex emulsion | 33.6 ml |

-continued

| | |
|---|---|
| (Copolymer of cyclohexyl methacrylate, isononyl acrylate, glycidyl acrylate and styrene-isoprene sulfonic acid; average diameter: 0.11 μm) | |
| 10% solid fine powder dispersion of zinc oxide (average diameter: 0.15 μm) | 10 ml |
| Solid fine powder dispersion of (A-9; average diameter: 0.1 μm) | 10 ml |
| 7%(W/V) aqueous solution of citric acid | 3.8 ml |
| 4%(W/V) aqueous solution of sodium styrene sulfonate | 23 ml |

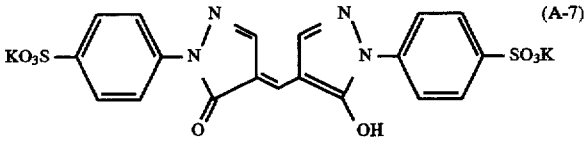

(A-7)

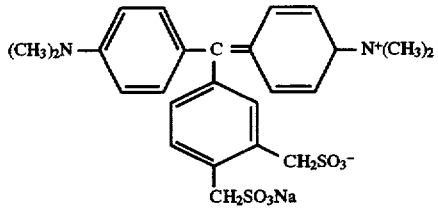

(A-8)

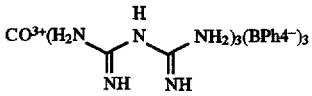

[Preparation of a coating solution for the backing layer BP-1]

A coating solution for the backing layer BP-1 was prepared by adding and mixing the additives given below, and adjusting with pure water so that the total volume became 711 ml.

| | |
|---|---|
| Gelatin | 24.9 g |
| Pure water | 605 ml |
| 2%(W/V) dispersion of methyl methacrylate (average diameter: 7 μ) | 72 ml |
| 4%(W/V) aqueous solution containing sodium salt of 1-decyl-2-(3-isopentyl) succinate-2-sulfonic acid | 11 ml |
| 4%(W/V) aqueous solution containing glyoxal | 4 ml |
| [Preparation of a solution containing a hardening agent BH-1 for adding to the backing layer inline] | |
| Pure water | 27.22 ml |
| Methanol | 1.5 ml |
| Hardening agent (A-10) shown below | 1.28 ml |
| NaCl | 0.005 g |

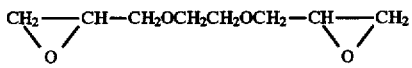

(A-10)

[Preparation of a coating solution for the silver halide emulsion layer]

A coating solution for the silver halide emulsion containing AgBrI emulsion, which comprises mono-disperse twin-crystal core/shell-type silver halide grains, of which silver iodide content of 2.0 mol %, average grain diameter of 0.4 μm, a grain diameter distribution width of 12%, average aspect ratio of 1.0 to 1.5 and ratio of {100} plane and {111}-plane is 64:36, and the following additives was prepared.

| | |
|---|---|
| 1,1-dimethylol-1-bromo-1-nitromethane | 70 mg |
| t-butyl catecol | 400 mg |
| Polyvinyl pyrrolidone (molecular weight: 10,000) | 1.0 mg |
| Styrene-maleic acid anhydride copolymer | 2.5 g |
| Nitrophenyl-treiphenyl phosphonium chloride | 50 mg |
| 2-anilino-4,6-dimercapto-s-triazine | 40 mg |
| Ammonium 1,3-dihydroxy benzene-4-sulfonate | 4 g |
| Sodium salt of 2-mercaptobenzimidazole-5-sulfonic acid | 1.5 mg |
| $C_4H_9OCH_2CH(OH)CH_2N(CH_2COOH)_2$ | 1 g |
| 1-Phenyl-5-mercaptotetrazole | 15 mg |

[Preparation of a solution for the protective layer]

Amount of additives used in the solution for the protective layer is given in terms of the amount per one liter of the solution.

| | |
|---|---|
| Lime-treated inert gelatin | 68 g |
| Acid treated gelatin | 2 g |
| Sodium-1-amyl-decylsulfo succinate | 0.3 g |
| Poly(methyl methacrylate (matting agent having area an average surface grain diameter of 3.5 μm) | 1.1 g |
| Silica dioxide (matting agent having an average surface grain diameter of 1.2 μm) | 0.5 g |
| $CH_2{=}CHSO_2CH_2OCH_2SO_2CH{=}CH_2$ | 500 mg |
| $C_4F_9SO_3K$ | 20 mg |
| $C_{12}H_{25}CONH(CH_2CH_2O)_5H$ | 2.0 g |
| $C_3F_{17}SO_2N(C_3H_7)(CH_2CH_2O)_{15}H$ | 100 mg |

[3] Preparation of a solution for the subbing treatment layer

Solution for the first subbing layer A

| | |
|---|---|
| Styrene-butadiene latex (Nippol LX432A; product of Nippon Zeon Co., Ltd.) | 25 parts by weight |
| Methyl cellulose (10%) | 10.0 Parts by weight |
| Silica-type matting agent (average diameter: 3.0 μ) | 0.5 part by weight |
| Sodium 2,4-dichloro-6-hydroxy-s-triazine | 0.5 part by weight |
| Pure water | 66 parts by weight |

Solution for the first subbing layer B

| | |
|---|---|
| Styrene-butadiene latex (Nippol LX432A; product of Nippon Zeon Co., Ltd.) | 25 parts by weight |
| Silica-type matting agent (average diameter: 3.0 μ) | 0.5 part by weight |
| Sodium 2,4-dichloro-6-hydroxy-s-triazine | 0.5 part by weight |
| Pure water | 24 parts by weight |

Dye Dispersion

To an aqueous solution, in which 5 parts by weight of a surface active agent(Triton X200, a product of Union Carbide co., ltd.)is dissolved in 285 parts by weight of water, 1 part by weight of citric acid, and 12 parts by weight of dye(A-11) were added and pre-dispersed with an ultrasonic mixer. Then this solution was put in a sand-mil (Igarashi machine manufacturing), added 1200 parts by weight of zirconium oxide beads and dispersed at 2000 rpm for 24 hours Diameter of the thus obtained solid dispersion dye was 0.1 μm.

Solution for the second subbing layer C

| | |
|---|---|
| Aqueous gelatin solution (10%) | 80 parts by weight |
| Methyl cellulose (10%) | 20 parts by weight |
| $C_{12}H_{25}O(CH_2CH_2O)_{10}SO_3Na$ | 4 parts by weight |

-continued

| | |
|---|---|
| (Proxel) | 0.3 part by weight |
| Hardening agent (A-12) | 0.5 part by weight |
| Add pure water to make the total volume of 1 liter. | |

Solution for the second subbing layer D

| | |
|---|---|
| Aqueous gelatin solution (10%) | 140 parts by weight |
| Matting agent (3 μm silica) | 5 parts by weight |
| Anion-nonion surface active agent (A-13) | 21 parts by weight |
| Dye dispersion | 75 parts by weight |
| Add pure water to make the total volume to be 1 liter | |

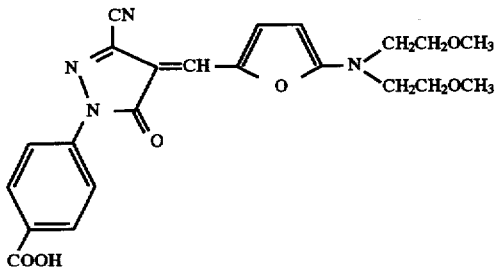

(A-11)

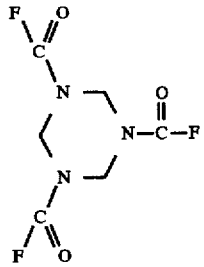

(A-12)

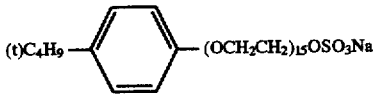

(A-13)

[4] Manufacture of a subbed support

Manufacture of a subbed support 1 (for example)

A SPS pellet, which was obtained in Synthesis Example 1 was melted at 330° C., extruded through a pipe on a cooled casting drum from a die-slit while applying electrostatic potential and cooled, to obtain a sheet, of which thickness is 1 mm. Said sheet was, after being pre-heated at 110° C., stretched in the longitudinal direction with stretching magnification degree at 3.3 times while heating by infrared heater, and was further stretched in the lateral direction with the stretching magnification degree at 3.3 times. Then, after thermally fixed at 230° C., to obtain a film of 100 μm thickness. After subjecting the both surfaces of the thus obtained film to corona discharge treatment, the both surfaces were discharged with an ion wind using an ion blower and, then, the coating solution for the subbing treatment A was coated on both surfaces one by one in order so that the dry thickness of the layer is set to be 1.0 μm, and, subsequently dried at 160° C.

Then the solution C for the second subbing treatment was coated on both surfaces one by one in order so that the dry thickness becomes to be 0.2 μm, and, then dried at 140° C.

This subbed base was then subjected to heat treatment for two minutes and was wound up after transported at 75° C. for ten minutes. This subbed substratum was cooled down to the room temperature spending three days.

Manufacture of a subbed support 2(for comparison)

In accordance with the disclosure of Japanese Patent O.P.I. Publication No. 3-131343(1991), a hydrophilic subbing coating was carried out in place of providing the above-mentioned layers.

| | |
|---|---|
| Aqueous gelatin solution (5% by weight) | 9 parts by weight |
| Pure water | 90 parts by weight |
| Aqueous formalin solution (4% by weight) | 1 part by weight |

The coating solution with the above-mentioned composition was coated on the film obtained in the above-mentioned Support 1 and dried at 100° C.

Manufacture of a subbed support 3

After coating the solution for the first subbing treatment in the same manner as in the case of support 1, solution for the second subbing treatment D was coated and dried at 140° C. Heat treatment was carried out in the same manner as support 1.

Manufacture of subbed support 4

The obtained sheet was pre-heated at 110° C. and subsequently stretched in the longitudinal direction at a stretching magnification of 3.3 times. Then the both surfaces were subjected to corona discharging treatment. Next, after the both surfaces were discharged with an ion bower (Type RH-20), the above-mentioned solution for the first subbing treatment A was coated with a wire bar coater so that the coating thickness after biaxial stretching becomes to be 0.2 μm, stretched in the lateral direction with a stretching magnification at 3,3 times and thermally fixes at 230° C.

The solution for the second subbing treatment C was coated on both surfaces in the same manner as in the case of subbed support 1 and, thereafter, the support was dried and thermally treated.

Manufacture of subbed support 5

Coating was carried out in the same manner as in the case of support 1, however in this example glow discharging treatment was carried out in stead of corona discharging treatment under the partial moisture pressure at 75% and 0.15 Torr.

[5] Coating of emulsion layers

Both surfaces of these subbed Supports 1,2,3 and 5 were simultaneously coated with Em-1 using a slide hopper.

With respect to support 4, both surfaces were simultaneously, provided that one surface was coated with Em-1 and the other surface was provided width a backing layer while in-line adding the hardening solution BH.

In both cases the protective layer was coated simultaneously with the emulsion layer.

[6] Evaluation of Properties (Evaluation of uneven coating)

Subbed supports 1,2.3 and 5 were subjected to the normal processing for a silver halide light-sensitive materials for X-ray use, and with respect to support 4, a normal processing for the light-sensitive materials for photo-lithography were conducted and evaluated visually.

1. remarkable uneven coating was observed and the emulsion layer is partially peeled off.
2. remarkable uneven coating was observed and partial repulsion was observed.
3. Uneven coating having rainbow color was observed.
4. A slight uneven coating was observed when looked obliquely.
5. No uneven coating observed.

(Evaluation of adhesion)

Adhesion before processing

Emulsion adhesion

After coating the emulsion layer, the surface of the silver halide emulsion layer of the samples were cut with a razor blade in cross stripes so that the scratches reaches the SPS film, put an adhesive Sellotape the surface of the scratched film and the thus scratched film surface was rapidly peeled off and the adhesion of the silver halide emulsion layer was evaluated according to the following five standards.

Standards for evaluation

1. Adhesive force is very weak, and a silver halide emulsion layer is completely peeled off.
2. The peeled off area is not less than 50%, and not less than 100%.
3. The peeled off area is not less than 20%, and not less than 50%.
4. The adhesive force is strong, and the peeled off area is not less than 5%, and not less than 20%
5. The adhesive force is very strong and the peeled off area is less than 5%.

When the standard for evaluation is not less than 4, it can be considered that the silver halide light-sensitive material has sufficiently strong adhesive force for practical use.

Wet-emulsion-adhesion

The samples were dipped in distilled water, and after 30 seconds, a silver halide emulsion layer is scratched with a pointed needle in order that scratch becomes the lattice of damages and the emulsion layer of the respective samples were rubbed strongly for the period of ten seconds with hands with rubber gloves thereon. Strength of adhesion was evaluated in five grades by measuring the area of the silver halide emulsion layer according to the similar standards as in the case of the pre processing adhesion. Results are shown in Table 1

TABLE 1

| Subbed Support No. | Uneven Coating | Emulsion adhesion | Wet-emulsion adhesion |
|---|---|---|---|
| 1 (Invention) | 4 | 4 | 5 |
| 2 (Comparative) | 2 | 2 | 1 |
| 3 (Invention) | 4 | 5 | 5 |
| 4 (Invention) | 5 | 5 | 5 |
| 5 (Invention) | 5 | 5 | 5 |

It is obviously understood that the supports of the present invention show excellent properties.

On the contrary, comparative samples show insufficient properties.

EXAMPLE 2

Supports Nos. 5 to 8 having silver halide emulsion layer respectively, were prepared in the same manner as [2 ] through [6] above, except that the following mentioned, and the same evaluations as in Example 1 were carried out.

Solution for the first subbing treatment E

| | |
|---|---|
| Styrene-butadiene latex No. 0545 (a product of Nippon Synthetic Rubber) | 20 parts by weight |
| Sodium dodecylbenzene sulfonate | 2 parts by weight |
| Silica-type matting agent (average diameter: 3.0 μm) | 1 part by weight |
| Sodium 2,4-dichloro-6-hydroxy-s-triazine | 1 part by weight |
| Pure water | 76 parts by weight |

Solution for the first subbing treatment F

| | |
|---|---|
| Acrylonitrile-butadiene latex No. 0910 (product of Nippon Synthetic Rubbers co., Ltd.) | 25 parts by weight |
| Sodium dodecylbenzene sulfonate | 2 parts by weight |
| Silica-type matting agent (average diameter: 3.0 μm) | 2 parts by weight |
| 2,6-diethyleneiminehexane | 1 part by weight |
| Pure water | 70 parts by weight |

Solution for the second subbing treatment G

| | |
|---|---|
| Aqueous gelatin solution (10%) | 80 parts by weight |
| Methyl cellulose (10%) | 20 parts by weight |
| Compound 7 | 4 parts by weight |
| Proxel | 0.3 part by weight |
| Crystaline tin oxide | 80 parts by weight |
| Silica-type matting agent (average diameter: 3.0 μm) | 5 parts by weight |

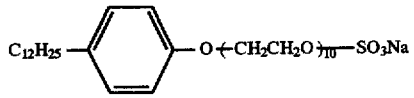

Manufacture of support 6 with silver halide emulsion (for example)

A SPS pellet, which was obtained in polymerization Example 2 was melted and extruded at 320° C. and casted on a casting drum, while applying electrostatic potential and cooled, to obtain a SPS sheet having thickness of approximately 1 mm. Obtained sheet was, after being pre-heated at 110° C., stretched in the longitudinal direction with stretching magnification degree at 3.3 times, and was further stretched in the tenter in the lateral direction with the stretching magnification degree at 3.3 times. Then, after fixing thermally at 230° C., the film was thermally reluxed at 110° C. by approximately 3% by reducing width of the clip. After undergoing corona discharge on one surface of the thus obtained 100-μm-thick film, the surface of the film was discharged by moisting water-vapor. Then, solution for the first subbing treatment E was coated thereon so that dry thickness of the layer became to be 0.4 μm and dried at 130° C. Then after conducting corona discharge on this layer coating, the solution for the second subbing treatment was coated so that dry thickness of the layer may be 0.1 μm and was dried at 150° C. Next, the other surface of the film was treated with flame, coated with the solution for the first subbing treatment F so that the dry thickness of the layer became 0.15 μm and was dried at 125° C. Further thereon after conducting flame treatment, the solution for the second subbing treatment B was coated so that the dry thickness of this layer may be 0.1 μm and was dried at 170° C. The obtained film was wound up while gradually cooling down the temperature to 80° C. and then, maintained at 50° C. for three days.

By the use of the thus obtained subbed support, a backing layer while inline adding a hardening agent BH-1 on the first coated surface, and a silver halide emulsion Em-1 on the second coated surface, were coated simultaneously on both surfaces of the support by the use of a slide hopper-type coater. In all cases, the protective layer was provided simultaneously with the emulsion layer.

Support 7 with an silver halide emulsion 7 (for comparison)

On the both surfaces of a SPS film support prepared in the same manner as Support 6, after undergoing corona discharge treatment, the following coating composition was coated according to the method disclosed in Japanese Patent O.P.I. Publication No. 3-131843(1991) so that the dry thickness of the layer may be 0.7 μm and dried at 100° C., to prepare a subbed support 7 for comparison.

| | |
|---|---|
| Aqueous gelatin solution (5% by weight) | 9 parts by weight |
| Pure water | 90 parts by weight |
| Formalin (4% by weight) | 1 part by weight |

On both surfaces of this layer, a silver halide emulsion Em-1 and the backing layer were provided in the same manner as in the case of subbed support 6, simultaneously with the protective layer using a slide hopper coater.

Support-8 with emulsion

A SPS pellet, which was obtained in polymerization Example 2 was melted and extruded at 320° C. and casted on a casting drum while applying electrostatic potential. Then the both surfaces of the thus obtained approximately 1 mm thick sheet underwent corona discharge treatment. This sheet was, after being pre-heated at 110° C., stretched in the longitudinal direction using an infra-red heater with stretching magnification degree of 3.3 times. Then, the both surfaces of this sheet underwent flame treatment and were coated with the solution for the first subbing treatment F so that the dry thickness of the layer became to be 0.2 μm and after this was dried in the tenter at 100° C., was further stretched in the lateral direction with the stretching magnification degree of 3.3 times, and fixed thermally at 230° C. Thus obtained film was thermally relaxed at 160° C. by approximately 3% by reducing width of the clip. The obtained film was wound up at 110° C. around a core with the outer diameter of 40 cm. This stainless core was cooled down at a cooling rate at 1° C./min. to 70° C. and then, maintained at this temperature for three days.

After the temperature of the core was cooled down to the room temperature, the solution for the second subbing treatment G and the solution for the second subbing treatment D were coated, after corona discharging treatment, on the inner surface and on the outer surface of the roll film, respectively so that dry thickness of the respective layers became to be 0.1 μm, and dried at 65° C. On the outer surface thereof Em-1 as an emulsion layer and on the inner surface thereof a backing layer while inline-adding a hardening agent BH-1, were provided, respectively together with a protective layer by simultaneous coating.

With respect to the thus obtained supports 6 through 8 with silver halide emulsion, after they are left in the atomospheric condition at 23° C., 55% R.H., adhesion strength of the both sides of the support was evaluated according to the same standards described in [6] above.

It is obvious from Table 2 that Support with an emulsion Nos 6 and 8 according to the present invention have excellent adhesion property, while Support with an emulsion No. 7, which is for comparison has only inferior properties.

EXAMPLE 3

The present invention is further explained with reference to working examples, however, the embodiments of the present invention are not limited to these, <Preparation of modified polyester A-1>

800 g of a polyester (product of Eastman Kodak Co.: WD-size)was put into 5600 g of heated water and stirred for five hours to dissolve. Then 200 g of styrene and 1.0 g of ammonium persulfate were added to this solution and reaction was performed at 80° C. for eight hours, to produce a polymer. In the present invention, the polyester obtained by the above-mentioned is defined as modified polyester.

<Preparation of modified polyester A-2>

Modified polyester A-2 was prepared in the same manner as in the preparation of A-1, except that styrene/methyl methacrylate/acrylic acid=6/2/2 was replaced with styrene.

<Preparation of modified polyester A-3>

Modified polyester A-3 was prepared in the same manner as in the preparation of A-1, except that styrene/glycidyl methacrylate=8/2 was replaced with styrene.

<Preparation of modified polyester A-4>

Modified polyester A-4 was prepared in the same manner as in the preparation of A-1, except that styrene/acrylamide/glycidylmethacrylate=7/2/1 was replaced with styrene.

<Preparation of Support-1>

SPS pellet, which was obtained in Synthesis Example 1 was melted at 330° C., extruded through a pipe on a cooled casting drum from a die-slit while applying electrostatic potential and cooled, to obtain a SPS unstretched sheet. Said unstretched sheet was, after being pre-heated at 115° C., stretched in the longitudinal direction with stretching magnification degree of 3.3 times, and was further stretched in the lateral direction with the stretching magnification degree of 3.3 times. Then, after fixing thermally at 225° C., while relaxing it slightly in the lateral direction, the sheet was subjected to heat relaxation at 170° C. for five minutes and cooled down to 100° C., and further thermally treated at 80° C. for about ten minutes, to obtain a support.

Then, the both surfaces of the thus obtained support were subjected to corona discharging treatment and, after coating the composition mentioned below was coated, it was dried at 140° C. for three minutes, to obtain Support-1.

TABLE 2

| | | Emulsion adhesion before processing | | Emulsion adhesion during processing | | Emulsion adhesion after processing | |
|---|---|---|---|---|---|---|---|
| Support with Emulsion No. | Uneven Coating | Emulsion Side | BC side | Emulsion Side | BC Side | Emulsion Side | BC Side |
| 6 (According to the Invention) | 5 | 4.5 | 4.5 | 5 | 5 | 5 | 4.5 |
| 7 (Comparison) | 2.5 | 2 | 1.5 | 1.5 | 1 | 1 | 1 |
| 8 (According to the Invention) | 5 | 5 | 5 | 5 | 5 | 5 | 5 |

| | |
|---|---|
| Modified polyester A-1 | 66 g |
| Compound I-7 (1.0% aqueous solution) | 3 g |
| Sodium 2,4-dichloro-6-hydroxy-s-triazine (1.5% aqueous solution) | 2 g |
| Add pure water to make the total volume to be | 100 g. |

<Preparation of Support 2>

Support 2 was prepared in the same manner as in Support 1, except that the modified polyester is replaced with a polyester of A-2.

<Preparation of Support 3>

66 g of modified Polyester 3 and Compound I-3(1.0% aqueous solution) according to the present invention were mixed and added pure water to make the total volume to be 100 g.

A SPS pellet, which was obtained in Synthesis Example 1 was melted at 330° C., extruded through a pipe on a cooled casting drum from a die-slit while applying electrostatic potential and cooled, to obtain a SPS unstretched sheet of 1000 μm. Said unstretched sheet was, after being pre-heated at 115° C., stretched in the longitudinal direction with stretching magnification degree of 3.3 times, and was further stretched in the lateral direction with the stretching magnification degree of 3.3 times. Then, after fixing thermally at 225° C., while relaxing it slightly in the lateral direction, the sheet was subjected to heat relaxation at 170° C. for five minutes and cooled down to 100° C., and further thermally treated at 80° C. for about ten minutes, to obtain Support 3.

<Preparation of Support 4>

Modified polyester A-4 and electroconductive Compound C were mixed at a weight ratio of A-4 to C being 55:35 by and then adjusted so that solid ingredient is 10% by weight. To 100 parts by weight of the thus prepared solution, 0.1 part by weight of Compound I-5 and 2 parts by weight of poly glycerin D were added, to prepare a solution for subbing treatment.

Water-soluble electrically conductive compound C

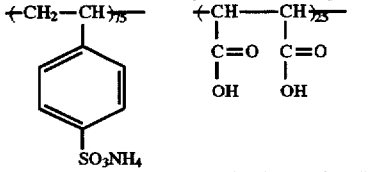

Weight average molecular weight = 5,000

Polyglycerin D (DAISHI)

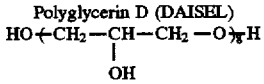

Support 4 was prepared in the same manner as in the preparation of Support 3.

<Preparation of Support 5>

According to the method disclosed in Japanese Patent O.P.I. Publication No. 3-131843(1991), an aqueous gelatin solution (5% by weight) and an aqueous formalin solution (4% by weight) were mixed at a proportion by weight of 7:1 and added pure water to make the total to be 100 parts. Then this solution was coated on the SPS sheet so that dry thickness became 0.7 μm and dried.

After an anti-electrostatic layer and a anti-halation layer were provided on the respective supports thus prepared, the following photographic constituent layers and a backing layer were formed by the use of a curtain coater. Herein, as the silver halide emulsion, a silver chlorobromide emulsion comprising tabular-shaped silver chlorobromide grains, silver chloride content of which is 60 mol % and inside of which has been doped with iridium at a quantity of $10^{-6}$ mol per mol of silver was used. The emulsion was sensitized with 8.2 mg of sodium thiosulfate, 163 mg of potassium thiocyanate, 5.4 mg of auric chloride and 2.0 mg of diphenylpentachlorophenyl chloride per 1 mol of silver, respectively. Average grain size and the average aspect ratio of the silver halide grains contained in the higher-sensitive emulsion layer are 0.13 μm and 1.5, respectively, those in the lower-sensitive layer are 0.14 μm and 2, respectively. and sensitivity difference between the higher-sensitive emulsion layer and the lower-sensitive emulsion layer was 32%.

<Photographic constituent layers>

First Layer(Reflection light-absorbing layer)

| | |
|---|---|
| Gelatin | 0.3 mg/m² |
| Matting agent (Average grain size: 2 μm) | 0.02 g/m² |
| solid dispersion dye (average grain size: 0.06 μm) | 0.03 g/m² |
| Solid particle dispersed dye B | |

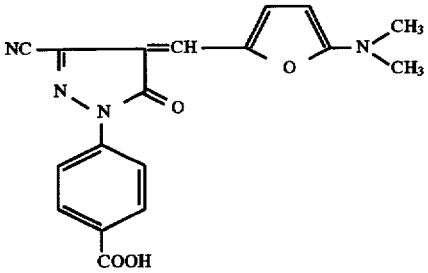

| | |
|---|---|
| Viscosity-increasing agent: Polystyrene Sulfonic acid (M.W. = 500,000) | 0.1 g/m² |
| Styrene-maleic acid copolymer | 0.1 g/m² |
| Polyvinyl pyrrolidone | 0.1 g/m² |

Second layer(Higher-sensitive emulsion layer

| | |
|---|---|
| Silver halide (converted into silver) | 1.5 g/m² |
| Gelatin | 1.0 g/m² |
| Poly(ethyl methacrylate-butylacrylate Copolymer latex | 0.5 g/m² |
| Solid dispersion hardening agent (average grain size: 0.12 μm) 1-formyl-2-{4-(2,4-di-tert-pentylphenoxy) butylamide]phenyl}hydrazine | 0.02 g/mol Ag |
| Sensitizing dye: Potassium salt of 5-[3-(4-sulfobutyl)-5-thiohydantion | $1 \times 10^{-3}$ mol/mol Ag |
| Viscosity-increasing agent: polystyrene sulfonic acid (M.W. = 500,000) | 0.1 g/m² |
| Styrene-maleic acid copolymer | 0.1 g/m² |
| Poly(vinyl pyrrolidone) | 0.1 g/m² |

Third layer(Intermediate layer)

| | |
|---|---|
| Gelatin | 0.3 g/m² |
| Viscosity-increasing agent: polystyrene sulfonic acid (M.W. = 500,000) | 0.1 g/m² |

Fourth Layer(Lower-sensitive emulsion layer)

| | |
|---|---|
| Silver halide (converted into silver) | 1.5 g/m² |
| Gelatin | 1.0 g/m² |
| Poly (ehtyl methacrylate-butyl acrylate) | 0.5 g/m² |

-continued

| | |
|---|---|
| copolymer latex | |
| Solid dispersion contrast increasing agent average particle size: 0.12 μm: 1-formyl-2-(4-[4-[2-(2,4-di-tert-pentylphenoxy)butylamide]phenyl)hydrazine | 0.02 g/mol Ag |
| Solid dispersion redox compount (average particle size: 0.12 μm: 1-(5-nitroindazole--1-il)-2-}4-[2,4-di-tert-pentylphenoxy)butylamide]phenyl)hydrazine | 0.02 g/mol Ag |
| Solid dispersion contrast increasing aid: bis (1-piperidino triethylene oxide) thio ether | 0.2 g/mol Ag |
| Sodium Nonylphenoxyethyleneoxide sulfonate | 0.2 g/mol Ag |
| Anti-foggant: | |
| Hydroquinon mon sulfonate | 12 mg/mol Ag |
| Hydroquinone aldoxym | 12 mg/mol Ag |
| 1-(p-carboxyphenyl)-5-mercapto tetrazole | 12 mg/mol Ag |
| Benzotriazole | 12 mg/mol silver |
| 1-butane sulfonic acid-2,3-dithiacyclohexane adenin | 12 mg/mol Ag |
| Butyl gallate | 12 mg/mol Ag |
| Sensitizing dye: Potassium salt of 5-[3-(4-sulfobutyl)-5-chloro-2-oxazolizidene]-1-hydroxyethyl-3-(2-pyridyl)-2-thiohydantion | $1 \times 10^{-3}$ mol/mol Ag |
| Viscocity-increasing agent: polystyrene sulfonic acid (M.W.: 500,000) | 0.1 g/m$^2$ |
| Styrene - maleic acid copolymer | 0.1 g/m$^2$ |
| Poly(vinylpyrrolidone | 0.1 g/m$^2$ |

Fifth layer(Lower protective layer)

| | |
|---|---|
| Gelatin | 0.5 g/m$^2$ |
| Viscosity-increasing agent; polystyrene sulfonic acid (M.W. = 500,000) | 0.1 g/m$^2$ |
| Styrene - maleic acid copolymer | 0.1 g/m$^2$ |
| Polyvinyl pyrrolidone | 0.1 g/m$^2$ |
| Ethyl methacrylate-butyl acrylate copolymer latex | 0.2 g/m$^2$ |
| Matting agent; silica dioxide (Average diameter; 4 μm) | 0.03 g/m$^2$ |
| Solid dispersion safe-light dye (average diameter: 0.06 μm): 4,4'-bis [1-(4-carboxyphenyl)-3-carboxyethylpyrazole-5-one]heptamethine | 60 mg/m$^2$ |
| Alkali-soluble solid dispersion of development inhibitor (average grain diameter: 0.07 μm): 4-Nitro indazole | 60 mg/m$^2$ |

Sixth layer(upper protective layer)

| | |
|---|---|
| Gelatin | 0.5 g/m$^2$ |
| Viscosity-increasing agent; polystyrene sulfonic acid (M.W. = 500,000) | 0.1 g/m$^2$ |
| Styrene - maleic acid copolymer | 0.1 g/m$^2$ |
| Polyvinyl pyrrolidone | 0.1 g/m$^2$ |
| Ethyl methacrylate-butyl acrylate copolymer latex | 0.2 g/m$^2$ |
| Matting agent; silica dioxide (Average diameter; 4 μm) | 0.03 g/m$^2$ |
| Solid dispersion safe-light dye (average diameter: 0.06 μm): 4,4'-bis [1-(4-carboxyphenyl)-3-carboxyethylpyrazole-5-one]heptamethine | 60 mg/m$^2$ |
| Alkali-soluble solid dispersion of development inhibitor (average grain diameter: 0.07 μm): 4-Nitro indazole | 60 mg/m$^2$ |

These layers were coated after pyrrolidinocarbamoyl pyridine ethane sulfonate was added as a hardener to the anti-halation layer in order that the amount of addition is 0.3 mmol/g with respect to gelatin contained in the whole layers.

<Preparation of a coating solution for the backing layer>

After mixing the composition given below, pure water was added to make the total volume to be 895 ml, to prepare a coating solution for the backing layer.

| | |
|---|---|
| Gelatin | 32.4 g |
| Pure water | 696 ml |
| 6% (W/V) aqueous solution of Dye C | 64 ml |
| 5% (W/V) aqueous solution of Dye D | 24 ml |
| 33% (W/V) aqueous solution of saponin | 6.6 ml |
| 20% (W/V) aqueous solution of polymer latex Copolymer of cyclohexyl methacrylate/iso-nonyl acrylate/glycidyl acrylate/styrene-isoprene sulfonate having average diameter of 0.10 μm | 33.6 ml |
| 10% (W/V) Solid dispersion of fine zinc oxide (average diameter; 0.15 μm | 10 ml |
| 6% (W/V) solid dispersion of Compound N (average diameter: 0.1 μm) | 10 ml |
| 7% (W/V) aqueous solution of citric acid | 3.8 ml |
| 4% (W/V) aqueous solution of sodium styrene sulfonate | 23 ml |

<Preparation of a coating solution for backing protective layer>

After mixing the composition given below, pure water was added to make the total volume to be 711 ml, to prepare a coating solution for the backing protective layer.

| | |
|---|---|
| Gelatin | 24.9 g |
| Pure water | 605 ml |
| 2% (W/V) aqueous solution of methyl methacrylate (average diameter: 7 μm) | 72 ml |
| 4% (W/V) aqueous solution of sodium 1-decyl-2-(3-isopentyl) succinate-2-sulfonate | 11 ml |
| 4% (W/V) aqueous solution of glyoxal | 4 ml |

To the above-mentioned coating solution for the backing protective layer, an aqueous solution containing a hardener, of which composition is given below, was added immediately before coating and both coating solutions were coated simultaneously so that coating amount of gelatin for the backing layer is 2.5 g/m$^2$ and that for the backing protective layer is 0.5 g/m$^2$, respectively.

| | |
|---|---|
| Pure water | 27.22 ml |
| Methanol | 1.5 ml |
| Hardener H1 | 1.28 ml |
| Sodium chloride | 0.005 g |

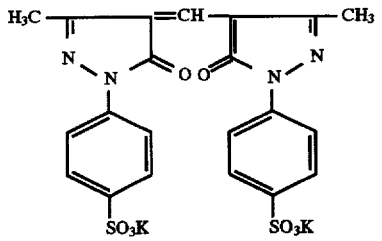

Dye C

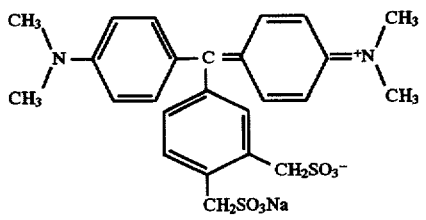

Dye D

-continued

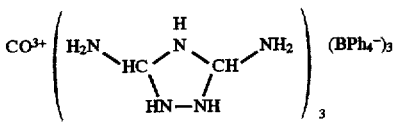

Compound N

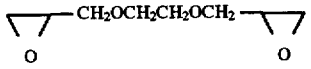

Hardening agent H1

Perspective properties were measured as follows:

<Adhesive property of the coated layer>

The coated film(primer layer)obtained by coating on the surface of a polyester film was cut with a razor blade at an angle of 45° put an adhesive Sellotape, peeled off rapidly the coating and the area of the primer layer which was peeled off was evaluated with five grades.

Standards for evaluation

1. Adhesive force is very weak, and the area of not less than 100% is peeled off.
2. The peeled off area is not less than 50%, and not less than 100%.
3. The peeled off area is not less than 10%, and not less than 50%.
4. The adhesive force is strong, and the peeled off area is not less than 5%, and not less than 10%
5. The adhesive force is very strong and the peeled off area is less than 5% or no substantial peeled off is obserbed.

<Cracking occurence in the primer layer>

After the primer layer has been coated, dyeing the primer layer with methylene blue, and the surface of the primer layer was observed with a microscope and evaluated according to the following evaluation standards.

1: Large cracks of not less than 50 μm are observed.

2: Small cracks of less than 50 μm are observed.

3: No substantial cracks are observed.

<Adhesion property of light-sensitive material>

In the samples in which a silver halide emulsion layer was provided on the SPS film having the primer layer, an adhesion property (hereafter referred to emulsion adhesion) before developing process, an adhesion property (hereafter referred to wet-emulsion adhesion) during developing process and an adhesion property (hereafter referred to dry-emulsion adhesion) after developing process are respectively evaluated by the following method.

<Emulsion adhesion>

After coating the emulsion layer, the surface of the silver halide emulsion layer of the samples were cut to have a lattice-like damage with a razor blade in order that the damage reaches to the SPS film, and an adhesive Sellotape is contacted to the surface of the damaged film and thus the surface of the damaged film was rapidly peeled off and the adhesive property of the silver halide emulsion layer was evaluated according to the following five standards.

Standards for evaluation

1. Adhesive force is very weak, and a silver halide emulsion layer is completely peeled off.
2. The peeled off area is not less than 50%, and less than 100%.
3. The peeled off area is not less than 20%, and less than 50%.
4. The adhesive force is strong, and the peeled off area is not less than 5%, and less than 20%
5. The adhesive force is very strong and the peeled off area is less than 5%.

When the standard for evaluation is not less than 4, it can be considered that the material has sufficiently strong adhesive force for practical use.

<Wet emulsion adhesion>

The samples were dipped in the developing solution, fixing solution and washing solution, respectively in this order and the emulsion layer of the respective samples were rubbed strongly for ten seconds with hands put on rubber gloves. Adhesive force was evaluated in five grades by measuring the area of the silver halide emulsion layer according to the similar standards as in the case of emulsion adhesion.

<Photographic properties—adaptability to practical photo-taking>

When using samples, in which a silver halide emulsion layer was provided on the SPS film support having a primer layer, a line image was photographed on a film by using a camera, and the film was developed at 28° C. for 6 seconds, fixed at 28° C. for 6 seconds, rinsed at 25° C. for 6 seconds and dried at 60° C. for 6 seconds by using an automatic processor, and the thus obtained line image was evaluated by visual observation having five grade steps.

1. not employed for commercial use.
2. employed, however, not preferable for commercial use.
3. employed for commercial use.
4. good for commercial use.
5. Excellent for commercial use.

Evaluation of photographic properties were made comprehensively in view of sensitivity, line image reproduction ability and graininess, etc. Results are given below.

| Sample No. | Support | Adhesion of coated layer | Existence of coated layer of cracks | Adhesiveness of light-sensitive material: Emulsion adhesion | Adhesiveness of light-sensitive material: Wet-emulsion adhesion | Photographic performance |
|---|---|---|---|---|---|---|
| 1 | 1 | 5 | 3 | 5 | 4 | 4 |
| 2 | 2 | 5 | 3 | 5 | 4 | 4 |
| 3 | 3 | 5 | 3 | 4 | 5 | 5 |
| 4 | 4 | 5 | 3 | 5 | 5 | 5 |
| 5 | 5 | 3 | 2 | 2 | 1 | 2 |

What is claimed is:

1. A silver halide photographic light-sensitive material comprising a support carrying a polymer layer and a silver halide emulsion layer, wherein said support comprises a syndiotactic styrene polymer or copolymer, and said polymer layer comprises a polymer composition composed of a polyester component and a styrene polymer component.

2. The silver halide photographic light-sensitive material of claim 1, wherein said polymer layer comprises a compound represented by Formula 1:

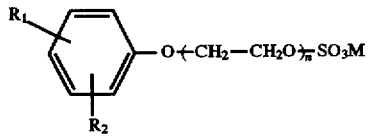

Formula 1 wherein R1 and R2 each represents a straight or an branched alkyl group having a carbon number of 1 to 18, M represents a cation, and n represents an integer of 1 to 50.

3. The silver halide photographic light-sensitive material of claim 1, wherein said syndiotactic styrene polymer or copolymer thereof contains a racemo-diad of not less than 85 mole %.

4. The silver halide photographic light-sensitive material of claim 3, wherein said syndiotactic styrene polymer or copolymer thereof comprises a racemo-diad represented by Formula 3:

Formula 3

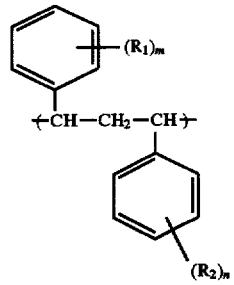

wherein $R_1$ and $R_2$ each represents a hydrogen, a chloro atom, a bromine atom, a fluorine atom, an iodine atom, an alkyl group, an aryl group, an alkoxy group, a carboxyl group, a sulfo group, a hydroxy group, an amino group, a sulfamoyl group, a carbamoyl group, a halogenated alkyl group, a cyano group, an alkoxycarbonyl group, m and n are individually an integer of 1 to 6.

5. The silver halide photographic light-sensitive material of claim 1, wherein said syndiotactic styrene polymer or copolymer thereof has a weight average molecular weight of 10,000 to 3,000,000.

6. The silver halide photographic light-sensitive material of claim 1, wherein said syndiotactic styrene polymer or copolymer thereof has a ratio of a number average molecular weight/to a average molecular weight of 1.5 to 8.

7. The silver halide photographic light-sensitive material of claim 1, wherein said syndiotactic styrene polymer is a syndiotactic styrene homopolymer.

8. The silver halide photographic light-sensitive material of claim 1, wherein said support comprises an isotactic styrene polymer or copolymer thereof.

9. The silver halide photographic light-sensitive material of claim 8, wherein a mixing ratio of said syndiotactic styrene polymer or copolymer to said isotactic styrene polymer or copolymer is 30:70 to 99:1 in terms of a weight ratio.

10. The silver halide photographic light-sensitive material of claim 1, wherein said polymer composition composed of a polyester component with a styrene polymer component is a graft polymer.

11. The silver halide photographic light-sensitive material of claim 1 wherein said polymer composition has a copolymerization ratio of said pollyester component to said styrene polymer component of 97:3 to 50:50 by weight.

12. The silver halide photographic light-sensitive material of claim 1 wherein said polymer layer further comprises a compound represented by Formula 2.

Formula 2

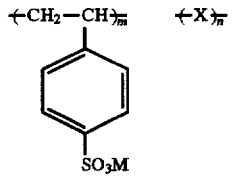

wherein n is 10 to 50 mol % based on Formula 2; m is 100 mol %−n; M is hydrogen, alkali metal, or alkaline earth metal, and x is another monomer capable of copolymerization with Formula 2.

13. The silver halide photographic light-sensitive material of claim 2 wherein said other monomer is selected from the class consisting of styrene, α-methylstyrene, vinyltoluene, p-methylstyrene, methyl acrylate, ethyl acrylate, butyl acrylate, 2-ethylhexyl acrylate, methyl methacrylate, 2-hydroxyethyl acrylate, 2-hydroxyethyl methacrylate, acrylic acid, methacrylic acid, crotonic acid, maleic acid, fumaric acid, itaconic acid, butadiene, isoprene, 2-chloro-1,3-butadiene, 1-chloro-1,3-butadiene, acrylonitrile, methacrylonitrile, vinyl chloride, vinylidene chloride, vinylethylketone, vinylmethylether, vinyl acetate, vinyl formate, allyl acetate, methylallyl acetate, acrylamide, N-methylol acrylamide, glycidyl acrylate, glycidyl methacrylate, acrolein, and allyl alcohol.

14. The silver halide photographic light-sensitive material of claim 13 wherein said Formula 2 has a number average molecular weight of 500 to 1,000,000.

15. The silver halide photographic light-sensitive material of claim 1 wherein said polymer layer further comprises a polyglycerin represented by the formula:

$$HO(CH_2CH(OH)CH_2O)_nH$$

wherein n is 2 to 20.

* * * * *